US008235107B2

(12) United States Patent
Fesi et al.

(10) Patent No.: US 8,235,107 B2
(45) Date of Patent: Aug. 7, 2012

(54) HYDRAULIC OIL WELL PUMPING APPARATUS

(75) Inventors: Michael A. Fesi, Houma, LA (US); Willard J. Lapeyrouse, Houma, LA (US); Kenneth H. Vincent, Carencro, LA (US)

(73) Assignee: Lufkin Industries, Inc., Lufkin, TX (US)

( * ) Notice: Subject to any disclaimer, the term of this patent is extended or adjusted under 35 U.S.C. 154(b) by 0 days.

(21) Appl. No.: 12/842,423

(22) Filed: Jul. 23, 2010

(65) Prior Publication Data

US 2011/0014064 A1 Jan. 20, 2011

Related U.S. Application Data

(63) Continuation of application No. 11/670,239, filed on Feb. 1, 2007, now Pat. No. 7,762,321.

(60) Provisional application No. 60/764,481, filed on Feb. 1, 2006, provisional application No. 60/824,123, filed on Aug. 31, 2006.

(51) Int. Cl.
*E21B 43/12* (2006.01)
*E21B 35/00* (2006.01)

(52) U.S. Cl. ..... 166/105; 166/68.5; 417/904; 91/219

(58) Field of Classification Search ..... 166/105, 166/68.5; 417/904; 91/219
See application file for complete search history.

(56) References Cited

U.S. PATENT DOCUMENTS 3,726,093 A 4/1973 Malott
4,320,799 A 3/1982 Gilbertson
4,430,924 A 2/1984 Dunn et al.
4,480,685 A 11/1984 Gilbertson
(Continued)

OTHER PUBLICATIONS

Variable Displacement Piston Pumps Series PAVC, Catalog HY28-2661-CD/US, pp. 1-46, Parker Ilannifin Corporation Hydraulic Pump Division, Marysville, Ohio, USA.

*Primary Examiner* — Kenneth L Thompson
(74) *Attorney, Agent, or Firm* — Garvey, Smith, Nehrbass & North, L.L.C.; Seth M. Nehrbrass; Charles C. Garvey, Jr.

(57) ABSTRACT

A hydraulic oil well pumping arrangement employs a compensating type hydraulic pump, a directional valving arrangement and a proportioning valving arrangement. When the directional valve is energized, oil is directed to the rod end of the hydraulic cylinder. The rod or piston part of the hydraulic cylinder will then elevate until a first limit switch is actuated which then will de-energize the directional valve and send a current signal to the proportional valve. This current signal to the proportional valve forces it to open to a point at which the cylinder rod would extend at the desired velocity until it reaches a second limit switch. The second limit switch is near the bottom (for example, 1 foot, or 0.30 meters) of travel of the rod or piston. The current signal to the proportional valve is then decreased, creating a choking arrangement that forces the cylinder rod to decelerate. The cylinder rod then reaches another limit switch. Upon reaching the third limit switch, the signal is removed from the proportional valve so that it closes. This halts a draining of fluid from the hydraulic cylinder. At the same time, a voltage signal is sent to the directional valve opening it so that pump flow again travels from the pump to the hydraulic cylinder and once again elevates the rod and the connected pumping string or sucker rod.

20 Claims, 31 Drawing Sheets

U.S. PATENT DOCUMENTS

| | | | |
|---|---|---|---|
| 4,490,097 | A | 12/1984 | Gilbertson |
| 4,503,752 | A | 3/1985 | Olson et al. |
| 4,571,939 | A | 2/1986 | Dollison |
| 4,631,918 | A | 12/1986 | Rosman |
| 4,646,517 | A | 3/1987 | Wright |
| 4,646,518 | A | 3/1987 | Hochsattel |
| 4,691,511 | A | 9/1987 | Dollison |
| 4,761,120 | A | 8/1988 | Mayer et al. |
| 5,143,153 | A | 9/1992 | Bach et al. |
| 5,390,743 | A | 2/1995 | Giannesini |
| 5,996,688 | A | 12/1999 | Schultz et al. |
| 6,017,198 | A | 1/2000 | Traylor et al. |
| 6,394,461 | B1 | 5/2002 | Henderson |
| 6,595,280 | B2 | 7/2003 | Traylor |
| 7,762,321 | B2 | 7/2010 | Fesi et al. |
| 2003/0085036 | A1 | 5/2003 | Curtis et al. |
| 2005/0155758 | A1 | 7/2005 | Webb et al. |
| 2007/0261841 | A1 | 11/2007 | Fesi et al. |
| 2008/0135259 | A1 | 6/2008 | Brown |
| 2008/0314581 | A1 | 12/2008 | Brown |
| 2009/0194291 | A1* | 8/2009 | Fesi et al. ..... 166/369 |

* cited by examiner

DOWN STROKE

DOWN STROKE

UP STROKE

UP STROKE

DOWN STROKE

DOWN STROKE

DOWN STROKE

DOWN STROKE

DOWN STROKE

UP STROKE

UP STROKE

UP STROKE

UP STROKE

HYDRAULIC OIL WELL PUMPING APPARATUS

CROSS-REFERENCE TO RELATED APPLICATIONS

This is a continuation of U.S. patent application Ser. No. 11/670,239, filed 1 Feb. 2007 (issuing as U.S. Pat. No. 7,762,321 on 27 Jul. 2010), which claimed priority of U.S. Provisional Patent Application Ser. No. 60/764,481, filed 1 Feb. 2006, and U.S. Provisional Patent Application Ser. No. 60/824,123, filed 31 Aug. 2006, each of which are hereby incorporated herein by reference.

International Application Number PCT/US07/61478, filed 1 Feb. 2007, is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to oil well pumps and more particularly to an improved hydraulic oil well pump that is electronically controlled using limit or proximity switches to control a valving arrangement that eliminates shock or excess load from the pumping string or sucker rod during pumping, and especially when changing direction of the sucker rod at the bottom of a stroke.

2. General Background of the Invention

Several patents have issued that relate generally to the pumping of oil from an oil well. Examples of those patents are contained in the following table, wherein the order of listing has no significance other than chronological.

TABLE

| PATENT NO. | TITLE | ISSUE DATE MM-DD-YY |
|---|---|---|
| 4,503,752 | Hydraulic Pumping Unit | 03-12-1985 |
| 4,761,120 | Well Pumping Unit and Control System | 08-02-1988 |
| 5,143,153 | Rotary Oil Well Pump and Sucker Rod Lift | 09-01-1992 |
| 5,390,743 | Installation and Method for the Offshore Exploitation of Small Fields | 02-21-1995 |
| 6,394,461 | Pressure Compensated Stuffing Box for Reciprocating Pumping Units | 05-28-2002 |
| 2003/0085036 | Combination Well Kick Off and Gas Lift Booster Unit | 05-08-2003 |
| 6,595,280 | Submersible Well Pumping System with an Improved Hydraulically Actuated Switching Mechanism | 07-22-2003 |
| 2005/0155758 | Well Tubing/Casing Vibrator Apparatus | 07-21-2005 |

BRIEF SUMMARY OF THE INVENTION

The present invention provides a hydraulic oil well pumping apparatus. The system of the present invention utilizes a hydraulic cylinder having a piston or rod that is movable between upper and lower piston positions. A pumping string or sucker rod extends downwardly from the piston, the pumping string or sucker rod being configured to extend into an oil well for pumping oil from the well.

A prime mover such as an engine is connected to a compensating type hydraulic pump.

A directional control valve moves between open flow and closed flow positions. A hydraulic flow line connects the pump and the hydraulic cylinder.

Electronic controls are provided that control movement of the piston as it moves between the upper and lower positions.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
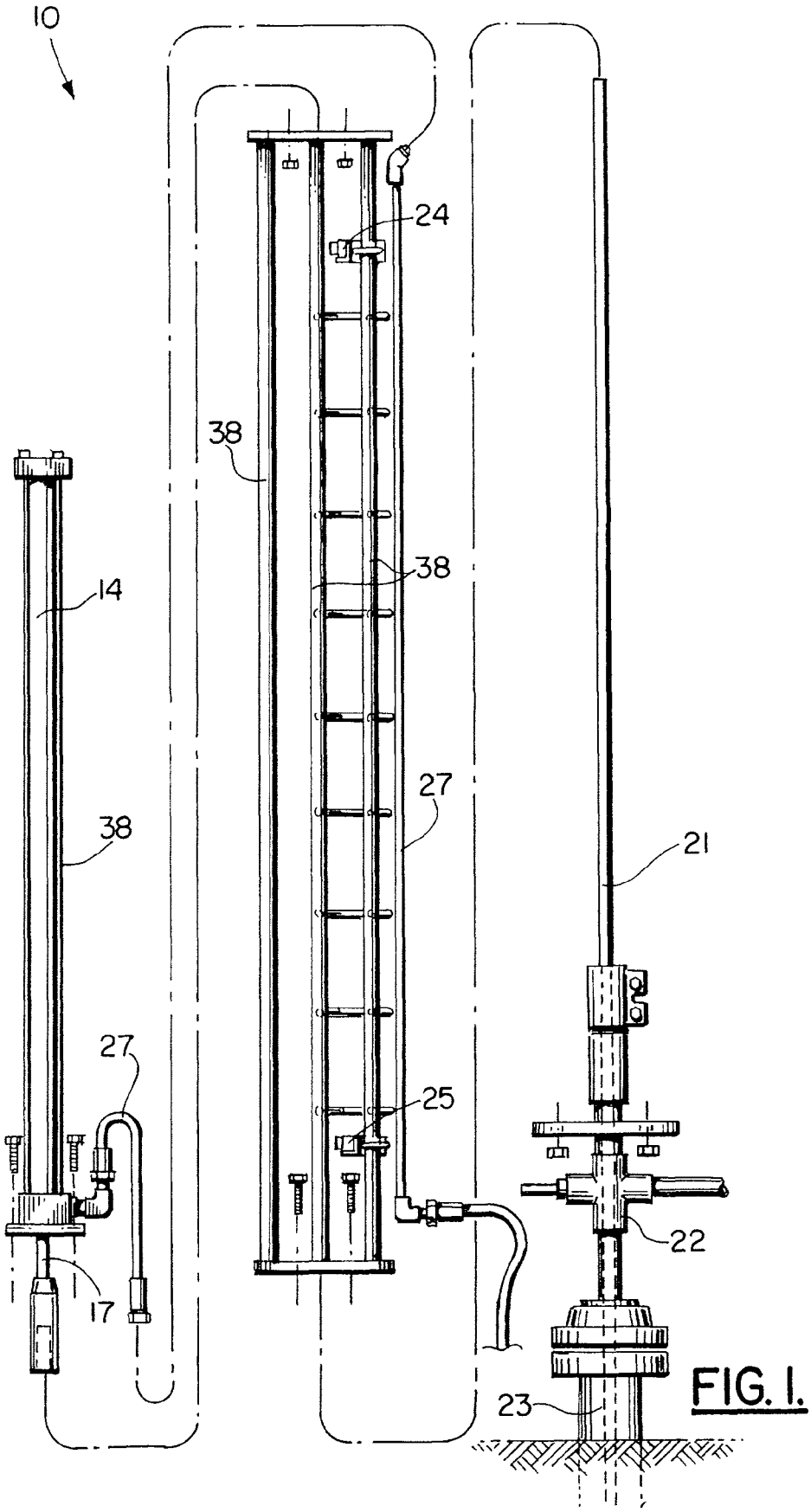
FIG. 1 is an exploded, elevation view of the preferred embodiment of the apparatus of the present invention.

FIGS. 1-7 show generally the preferred embodiment of the apparatus of the present invention designated generally by the numeral 10.

Oil well pump 10 provides a reservoir 11 for containing hydraulic fluid. A prime mover 12 such as an engine is provided for driving a compensating pump 13. The pump 13 is used to transmit hydraulic pressure, pressurized hydraulic fluid received from reservoir 11 via flow line 33 to a hydraulic cylinder or petroleum lift cylinder 14. Lift cylinder 14 can be a Parker (www.parker.com) model GG699076A0. The hydraulic lift cylinder 14 includes a cylinder body 15 having a hollow interior 16.

A cylinder rod 17 is mounted in sliding or telescoping fashion to the cylinder body 15 extending into the interior 16 of cylinder body 15. The cylinder rod 17 has an upper end portion 18 and a lower end portion 19. During use, the lower end portion 19 extends below cylinder body 15 as shown in FIGS. 1-4C and 6-7.

In FIG. 1, the lower end portion 19 of cylinder rod 17 is attached with coupling 20 to a pumping string or sucker rod 21. The pumping string or sucker rod 21 is comprised of a number of joints, connected end to end. A pumping part of the sucker rod 21 is generally positioned next to a perforated zone of the well. Such a pumping string 21 or sucker rod 21 is known in the art and is used to pump oil from an oil well as the sucker rod 21 moves up and down.

Figure 2:
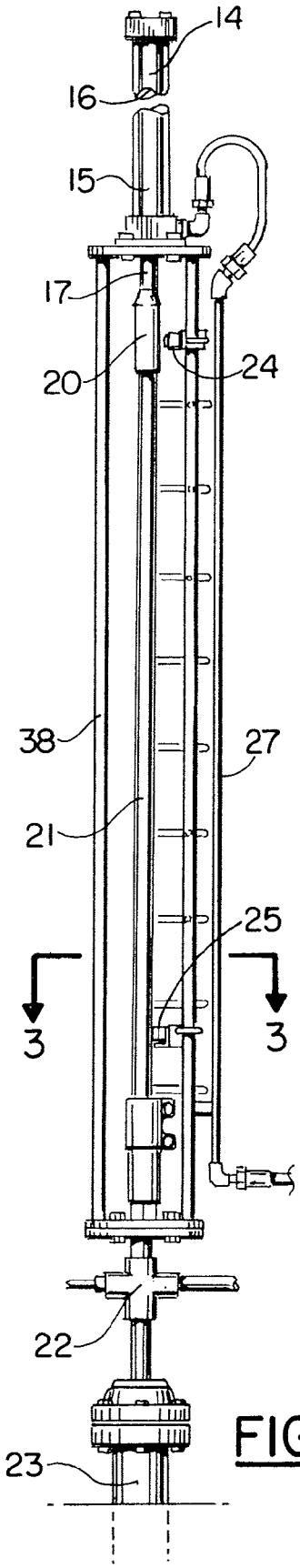
FIG. 2 is an elevation view of the preferred embodiment of the apparatus of the present invention.
Figure 3:
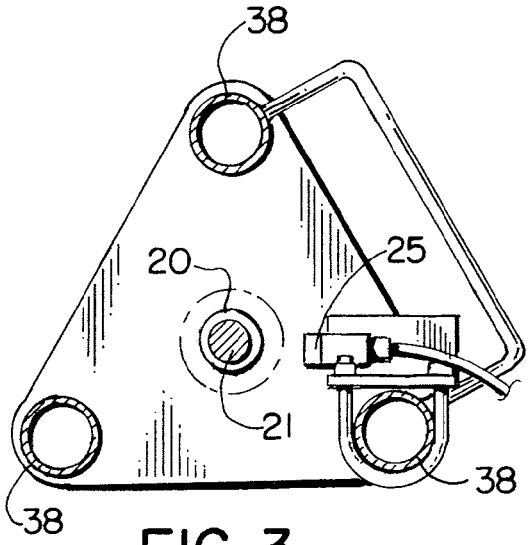
FIG. 3 is a sectional view of the preferred embodiment of the apparatus of the present invention, taken along lines 3-3 of FIG. 2.
Figure 2A:
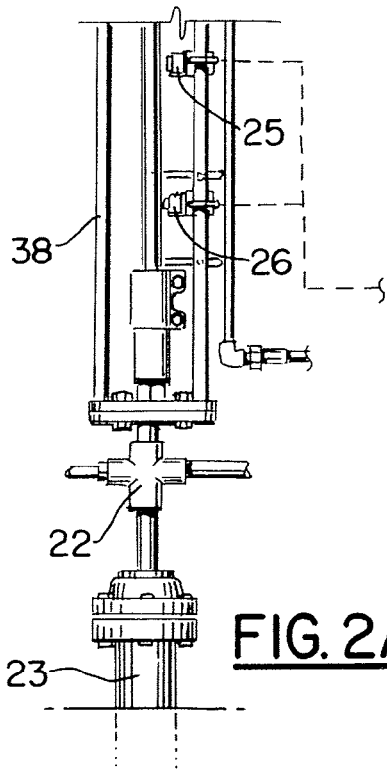
FIG. 2A is a partial elevation view of the preferred embodiment of the apparatus of the present invention.

The lift cylinder 14 is mounted upon Christmas tree 22. The Christmas tree 22 is mounted at the well head of an oil well at the upper end portion of well pipe 23. A suitable structural frame 38 can be used for supporting hydraulic cylinder 14 and its cylinder rod 17 above Christmas tree 22 as shown in FIGS. 1-4C and 6-7. A plurality of proximity or limit switches 24, 25, 26 are provided. Switches 24, 25, 26 can be for example those manufactured by Turck Company, model number N120-CP40AP6X2/510. As shown in FIGS. 2-2A, these proximity or limit switches 24, 25, 26 can be mounted to frame 38. During use, these proximity or limit switches 24, 25, 26 can be used to sense the position of the lower end portion 19 of cylinder rod 17 and then send an electronic signal to the controller 39 (commercially available), then the controller 39 sends a signal to the manifold 35 that includes directional valve 28, proportioning valve 31, and ventable relief valve 37 (e.g. Parker Sterling model no. A04H3 HZN).

Hydraulic fluid flow lines are provided for transmitting hydraulic fluid under pressure to hydraulic lift cylinder 14 via flow lines 27, 29. Directional valve 28 receives flow from flow line 29. Flow line 27 extends between directional valve 28 and cylinder 14. To initiate operation, pump 13 transmits fluid flow through the manually vented relief valve 37 thus removing pressure from the system prior to start up. When the engine or prime mover 12 is started, it activates the hydraulic pump 13, flow still initially traveling through the relief valve 37 and flow line 34 to reservoir 11.

The cycle of operation begins by vent closure of valve 37 so that oil flowing in flow line 29 now travels to directional valve 28. At about the same time, the directional valve 28 is energized so that oil under pressure is directed via flow line 27 to hydraulic lift cylinder 14 body 15 and its hollow interior 16. The cylinder rod 17 will then elevate, lifting the pumping string 21 or sucker rod 21 with it (see FIG. 2).

Frame 38 carries the plurality of proximity or limit switches 24, 25, 26. When the cylinder rod 17 reaches the top of its stroke, the proximity switch 24 (which is an uppermost proximity switch) senses the position of coupling 20 and energizes the directional valve 28 so that it closes the flow line 29 and flows through proportional valve 31. Valve 31 is a manual proportional valve with flow check for restricted flow on return of hydraulic oil to the reservoir, thus allowing a restricted flow to control the rate of descent of cylinder rod 17. Because the pump 13 is a compensating pump, it continues to run but does not continue to pump fluid. It can be set to halt fluid flow at a certain pressure value (e.g. 3000 psi, or 210.92 $kgf/cm^2$) which can be set by design depending upon the weight of sucker rod 21. In other words, pump 13 is volume compensating and pressure responsive. Such a compensating pump is manufactured by Parker such as their model no. P1100PS01SRM5AC00E1000000.

When the directional valve 28 is used to close flow line 29, the compensating pump 13 continues to rotate with the engine 12 but no longer pumps fluid in flow line 29. The directional valve 28 opens drain line 30 at about the same time that line 29 is closed. Fluid in hydraulic cylinder 14 now drains via flow lines 27 and 30 through proportioning valve 31 and cylinder rod 17 descends relative to cylinder body 15. The hydraulic fluid draining from cylinder body 15 interior 16 continues to flow via flow lines 27 and 30 through proportioning valve 31 and cooler 36 and then into flow line 32 which is a drain line to reservoir 11. The flow line 32 can be provided with oil cooler 36 (e.g. Thermal Transfer model BOL-8-1-9) and an oil filter (e.g. Parker model no. RF2210QUP35Y9991) if desired.

Figure 4A:
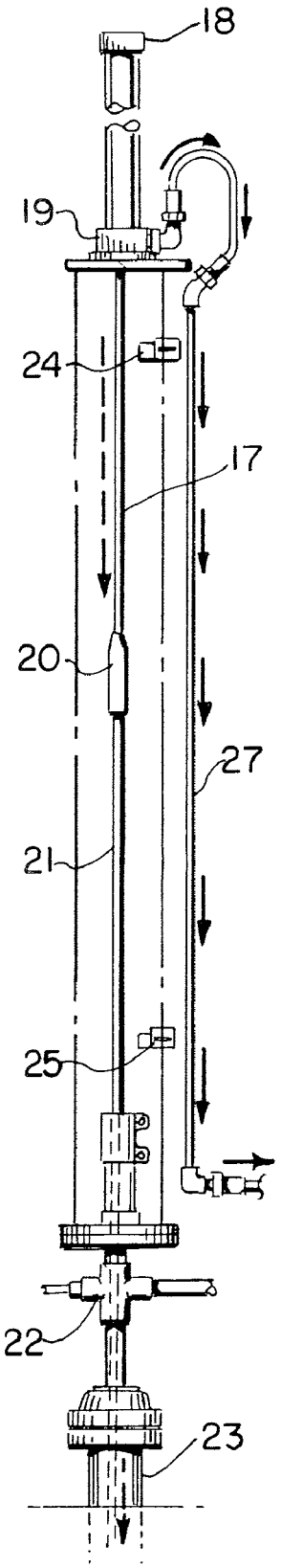
FIGS. 4A, 4B and 4C are fragmentary, elevation views of the preferred embodiment of the apparatus of the present invention illustrating operation of the apparatus.
Figure 4B:
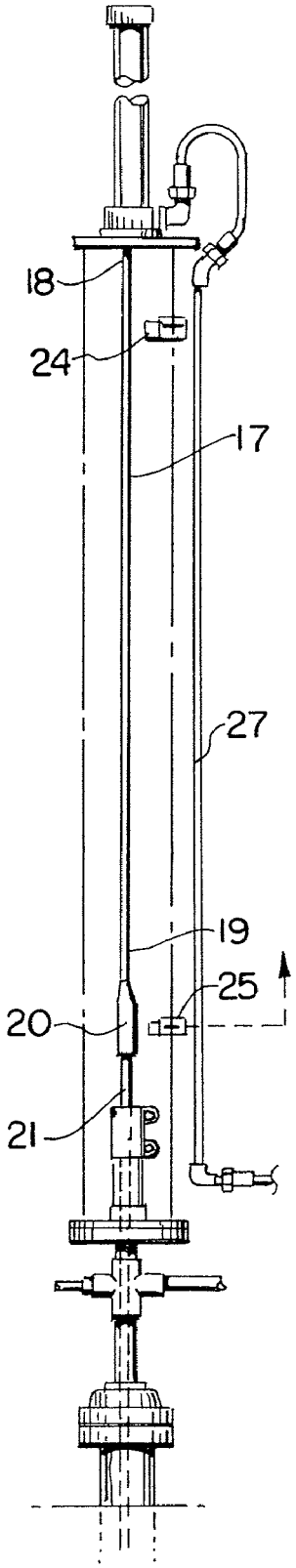
Figure 4C:
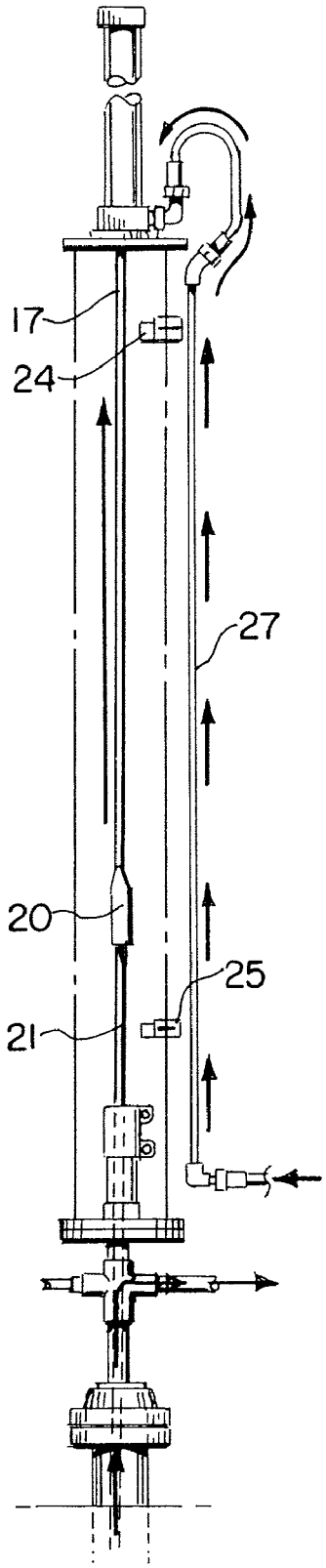
Figure 5:
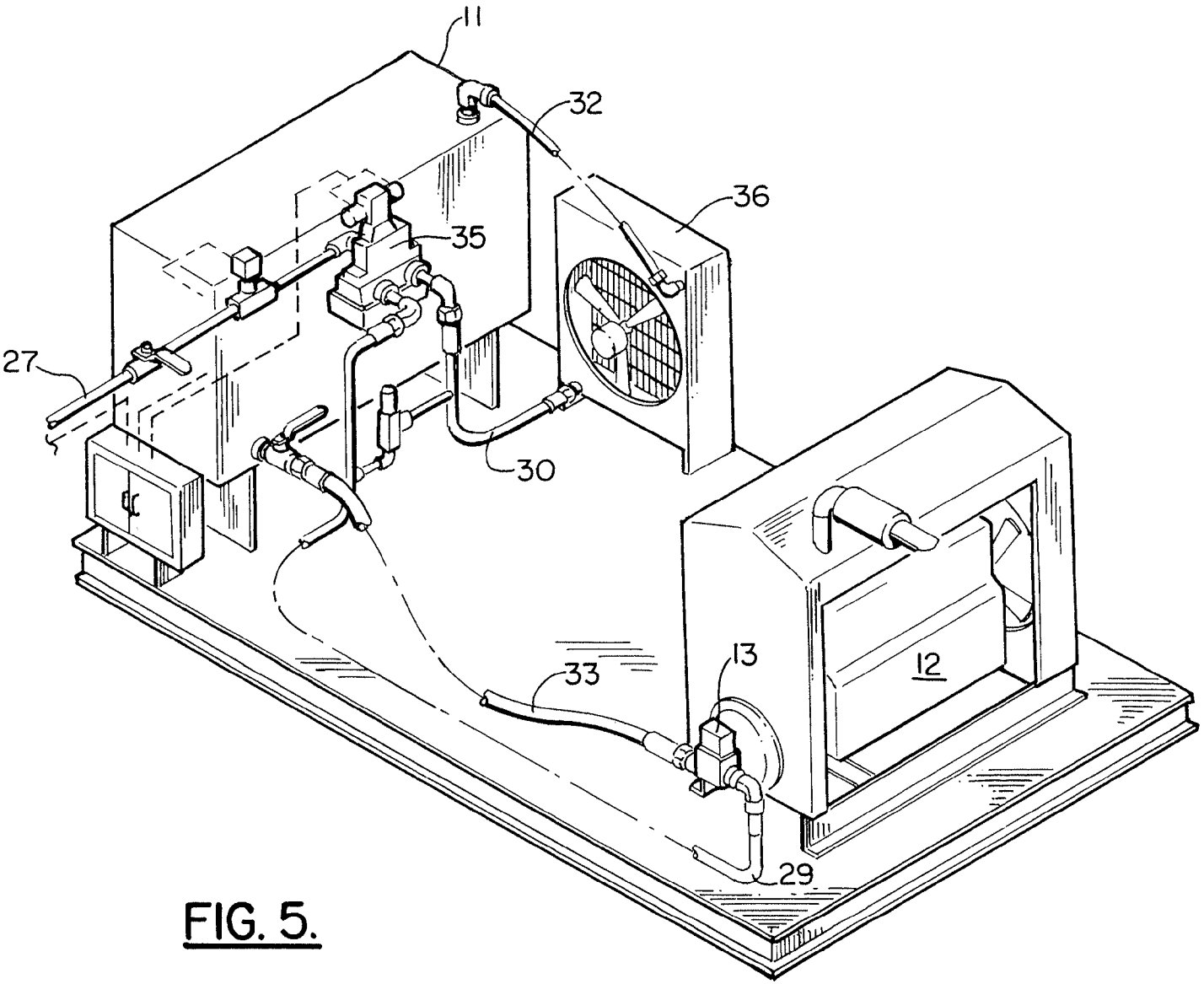
FIG. 5 is a partial perspective view of the preferred embodiment of the apparatus of the present invention.
Figure 6:
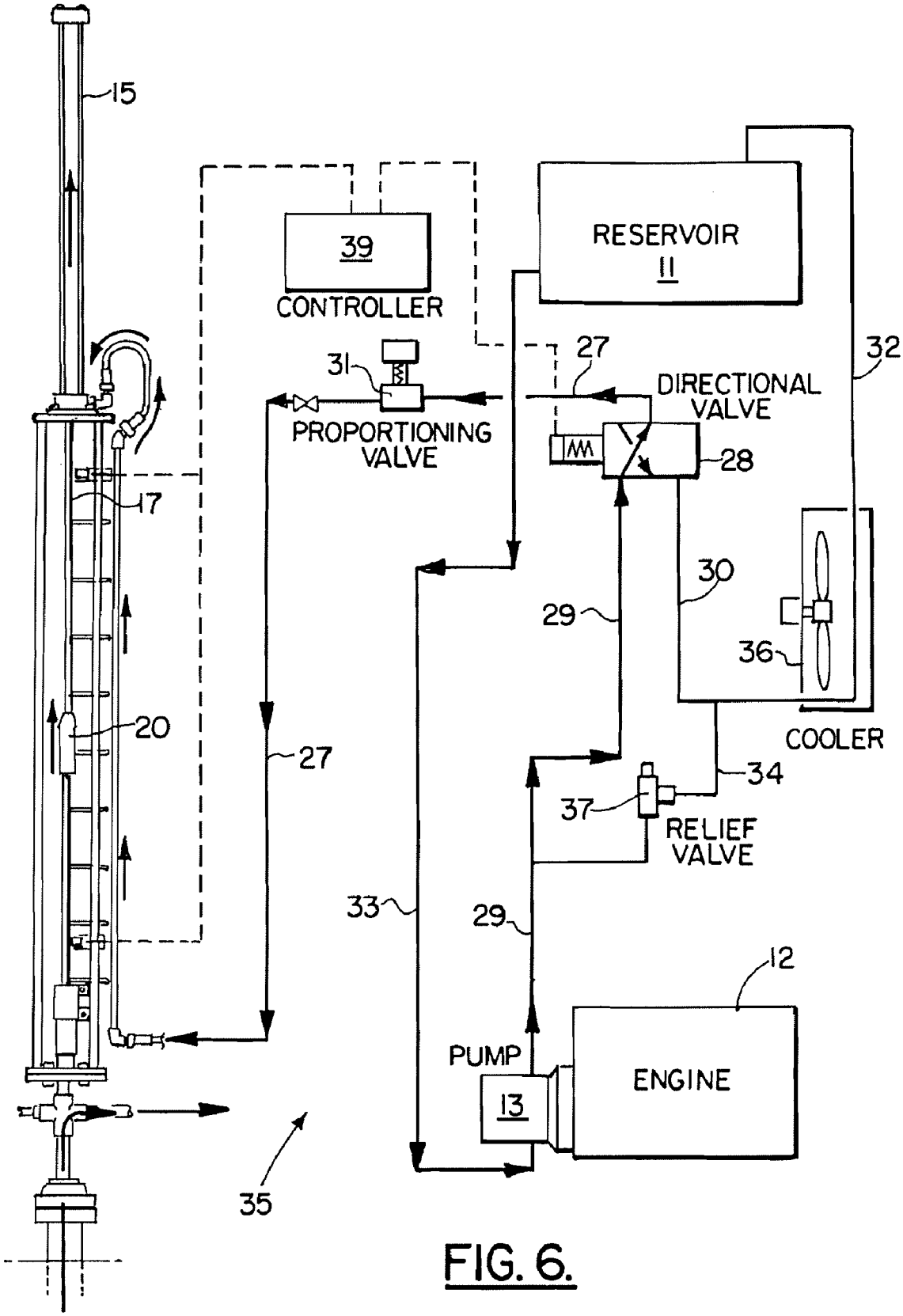
FIGS. 6-7 are schematic diagrams of the preferred embodiment of the apparatus of the present invention.
Figure 7:
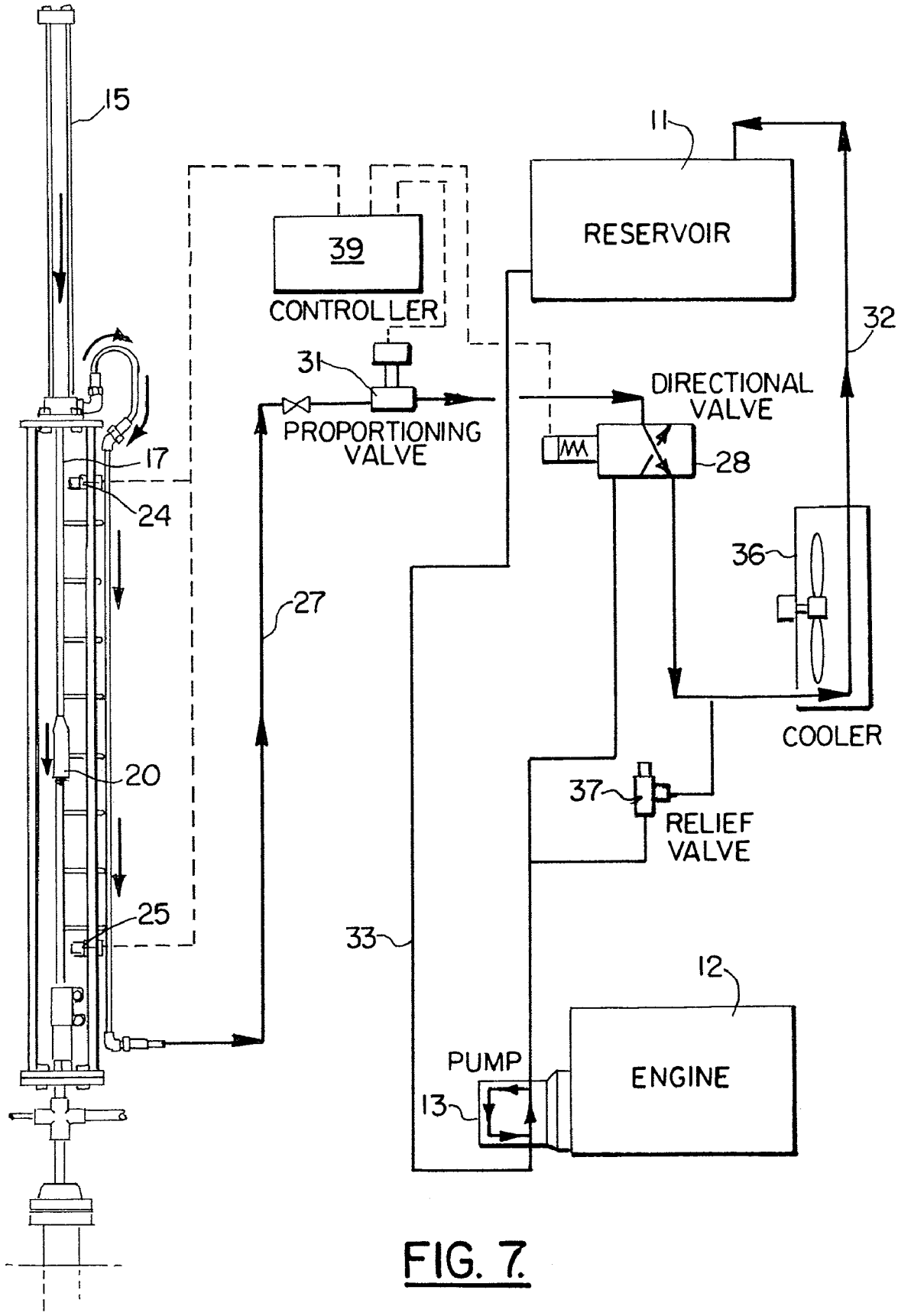

Since pressure no longer forces cylinder rod 17 upwardly, it begins to drop (see FIGS. 4A and 7). As it drops relative to lift cylinder body 15, coupling 20 will meet a second proximity or limit switch 25 which is below limit switch 24 (see FIGS. 2, 4A, 4B, 4C). The limit switch 25 is closer to the lower end portion (for example, 1 foot, or 0.30 meters) of cylinder body 15 than to upper end portion of body 15. When the coupling 20 reaches proximity or limit switch 25, in one embodiment (FIG. 2A) it signals the directional valve 28 that it should switch to allow the flow of fluid to travel through the proportioning valve 31 via flow lines 27, 30.

The proportioning valve 31 is a manual proportioning valve with flow check for restricted flow on return of hydraulic oil to the reservoir. When the coupling 20 reaches the proximity or limit switch 25, the directional valve switches to direct the flow to lift the cylinder 14. The choking action that takes place in the proportioning valve 31 has the effect of gradually slowing the speed of the cylinder rod 17 and its connected sucker rod 21. The use of Parker No. FMDDDSM Manapac manual sandwich valve located between directional valve and the solenoid controls dampens the transition of the directional valve from the upstroke or downstroke to allow bumpless transfer of fluid to the cylinder 14 and balances pressures. This choking of flow by the proportioning valve 31 also slows action of cylinder rod 17, preventing undue stress from being transmitted to the sucker rod 21 as the bottom of the downstroke of cylinder rod 17 is approached, then reached.

Directional valve 28 can be a Parker® valve model number D61VW001B4NKCG. Proportioning valve 31 can be a Parker® valve model number DFZ01C600012.

Figure 8:
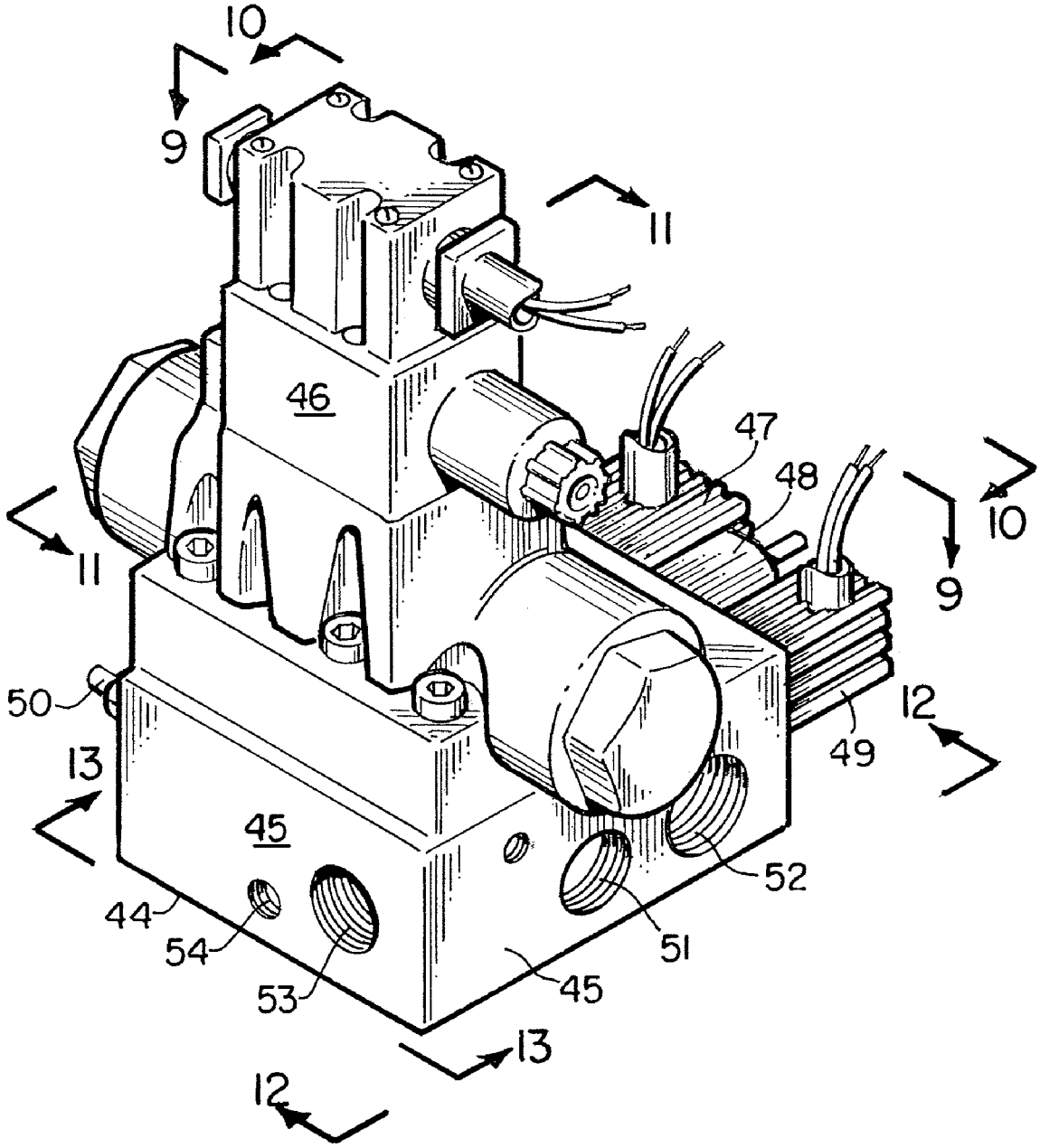
FIG. 8 is a partial perspective view of the alternate embodiment of the apparatus of the present invention.
Figure 9:
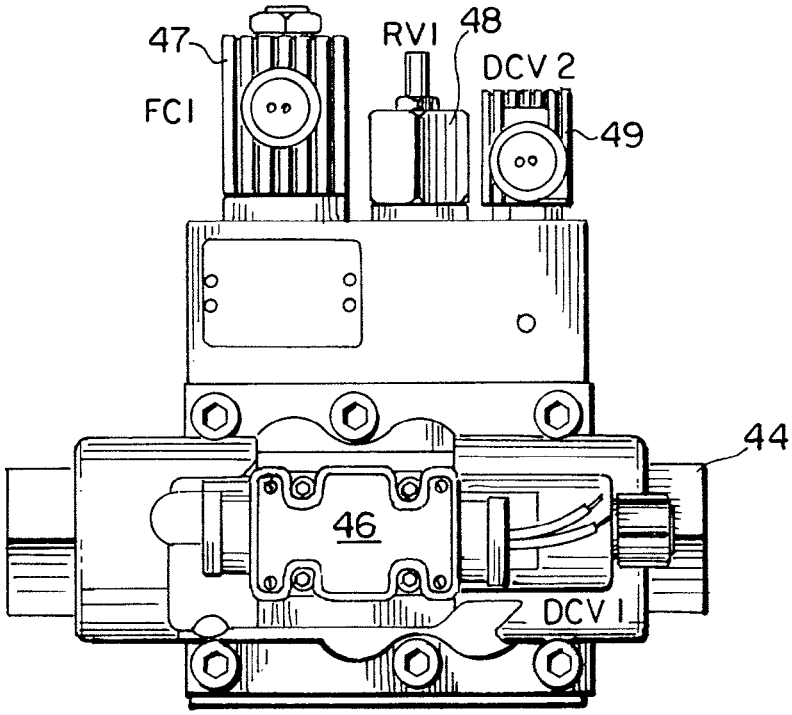
FIG. 9 is a fragmentary top view of the alternate embodiment of the apparatus of the present invention.
Figure 10:
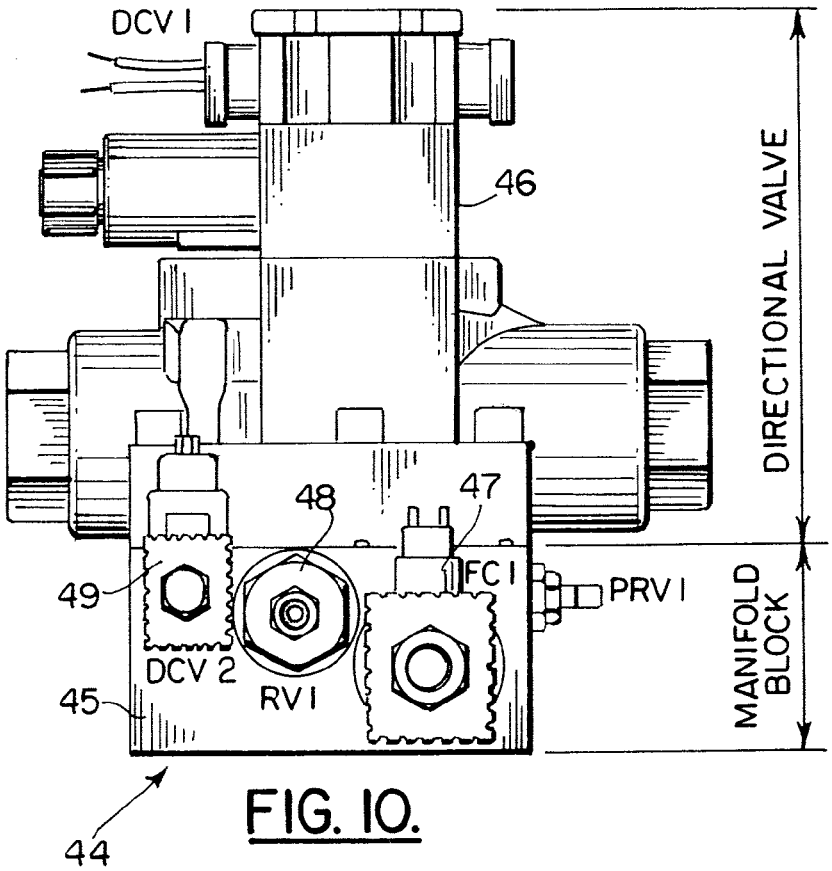
FIG. 10 is a partial elevation view of the alternate embodiment of the apparatus of the present invention.
Figure 11:
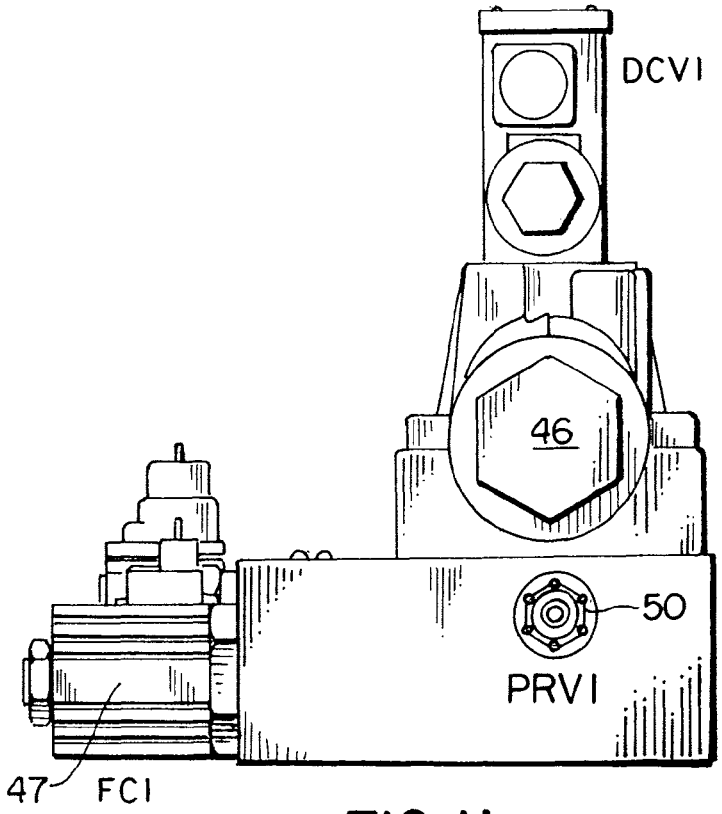
FIG. 11 is a partial end view of the alternate embodiment of the apparatus of the present invention.
Figure 12:
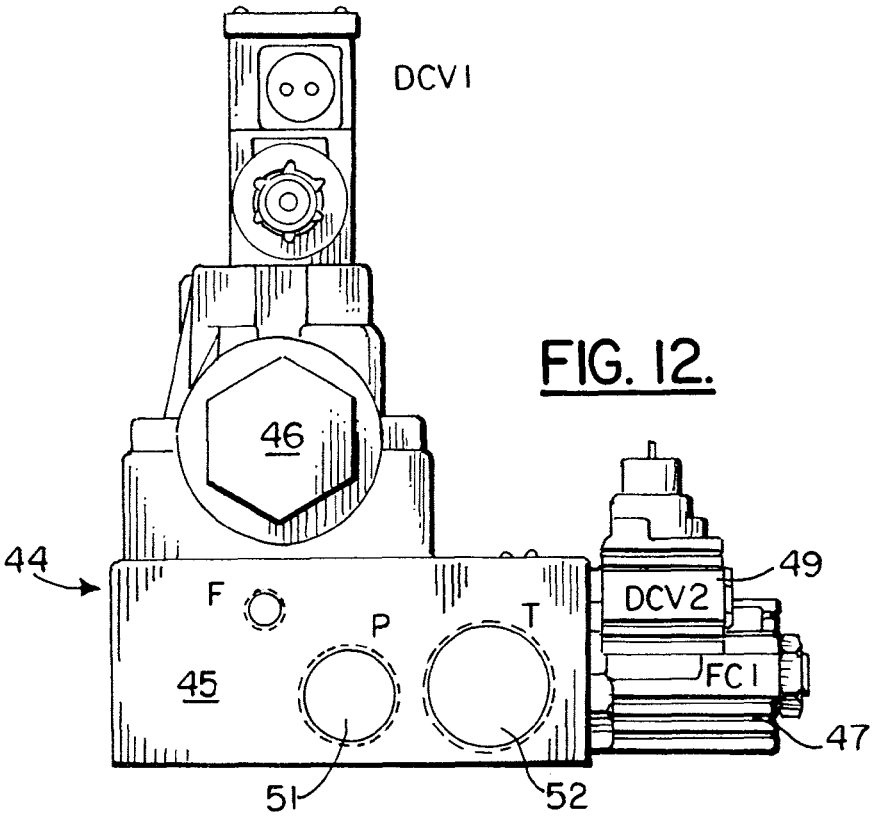
FIG. 12 is another fragmentary elevation view of the alternate embodiment of the apparatus of the present invention.
Figure 13:
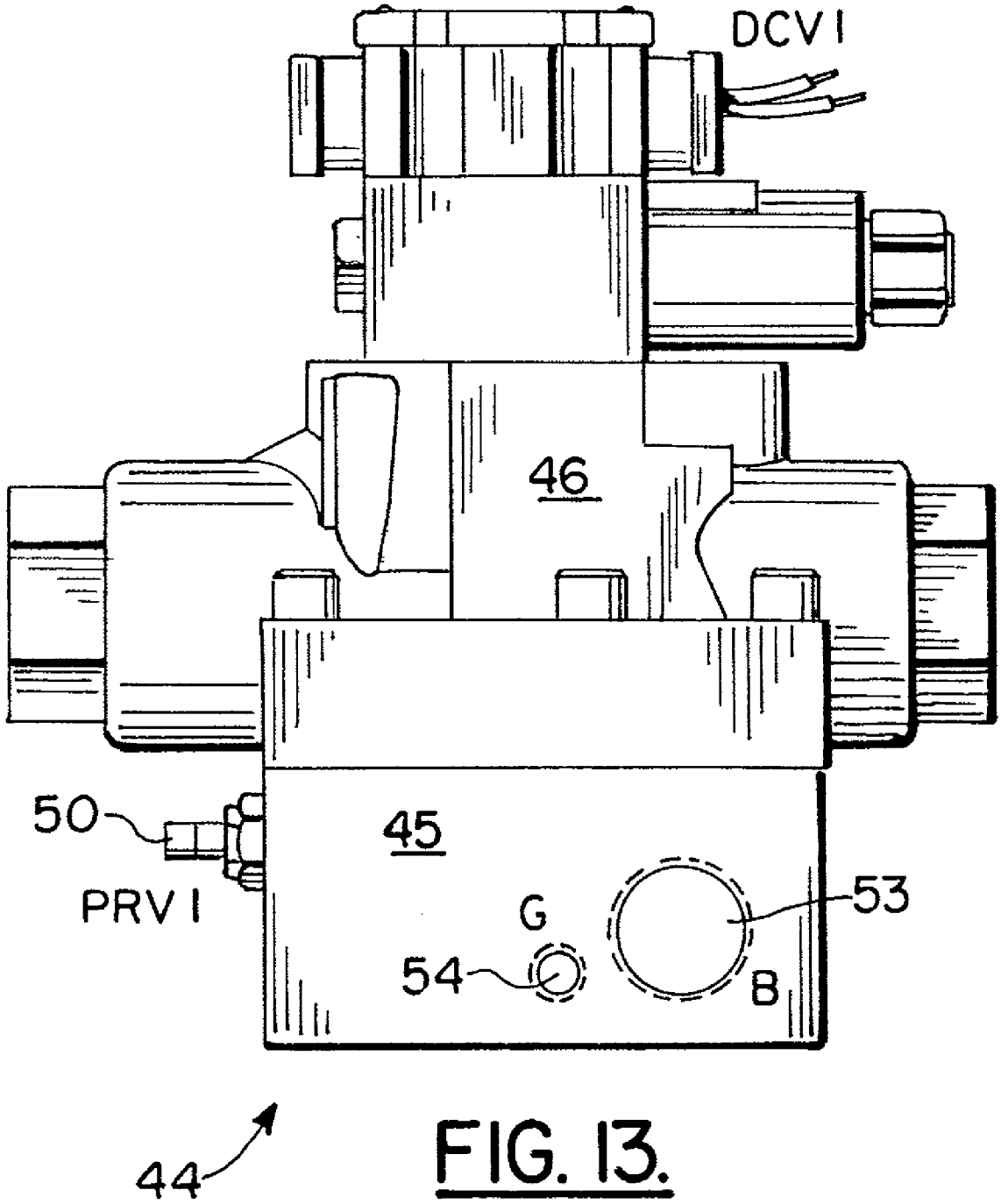
FIG. 13 is a fragmentary side view of the alternate embodiment of the apparatus of the present invention.
Figure 14:
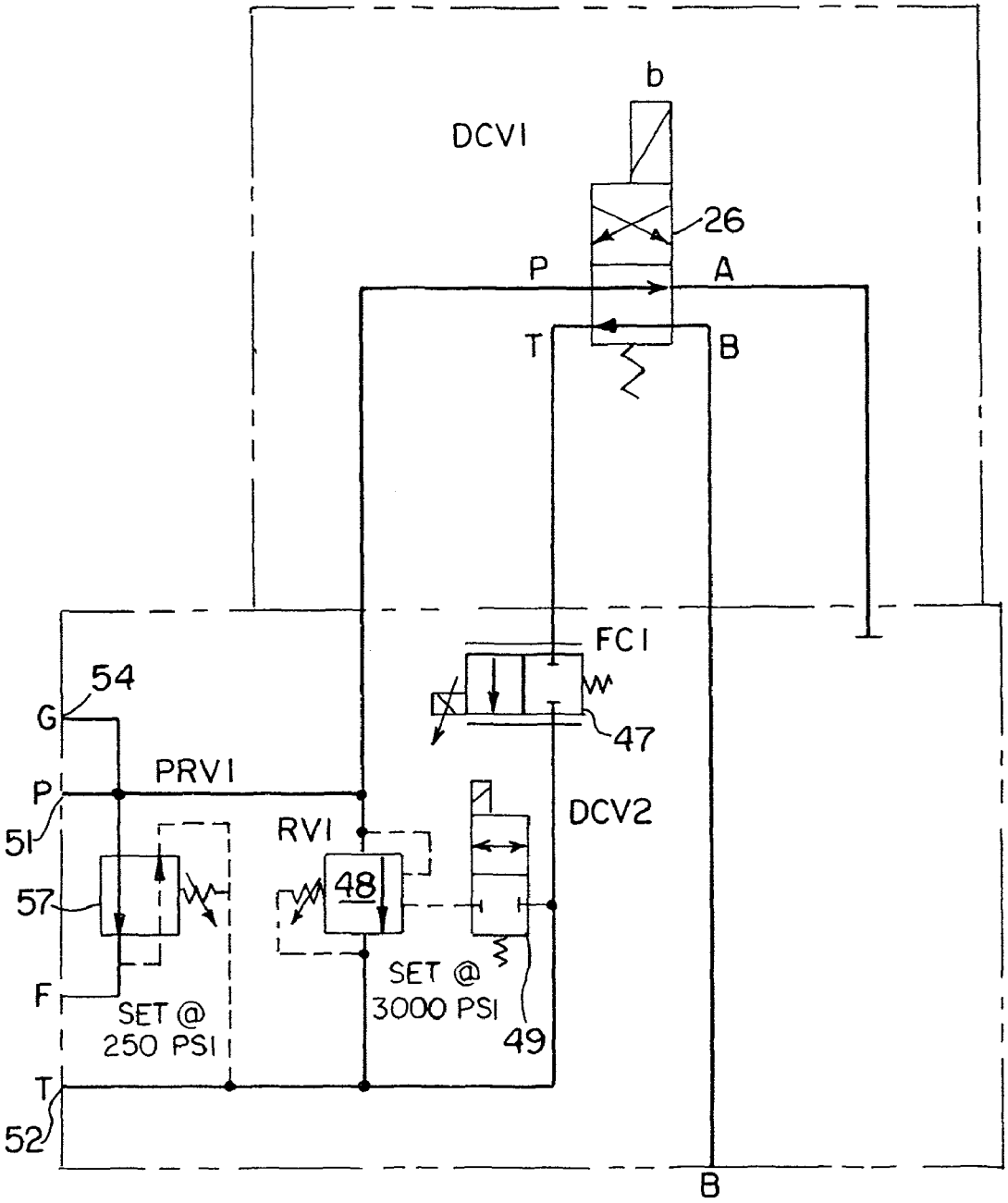
FIG. 14 is a flow diagram illustrating the alternate embodiment of the apparatus of the present invention.
Figure 15:
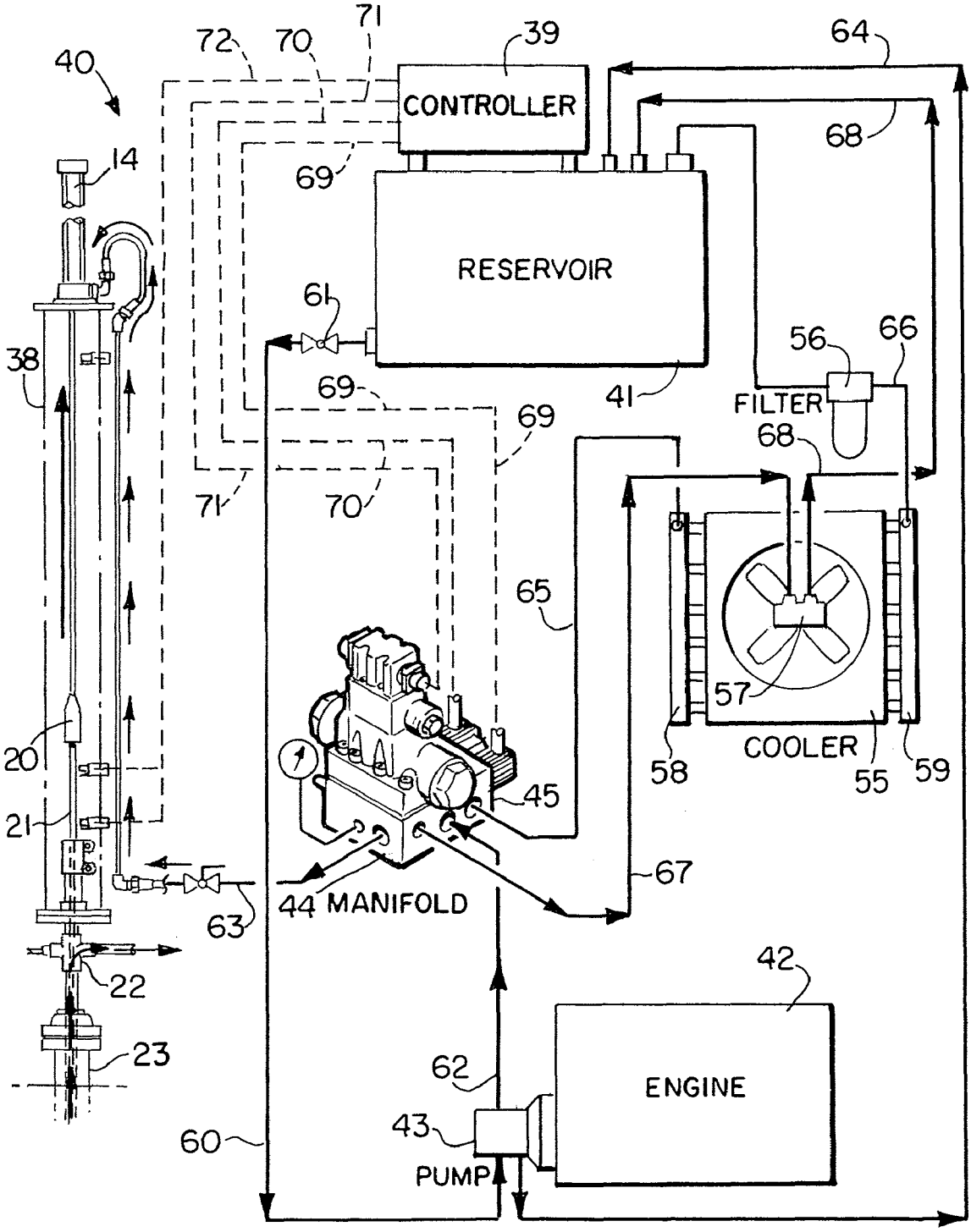
FIGS. 15-16 are schematic diagrams showing the alternate embodiment of the apparatus of the present invention.
Figure 16:
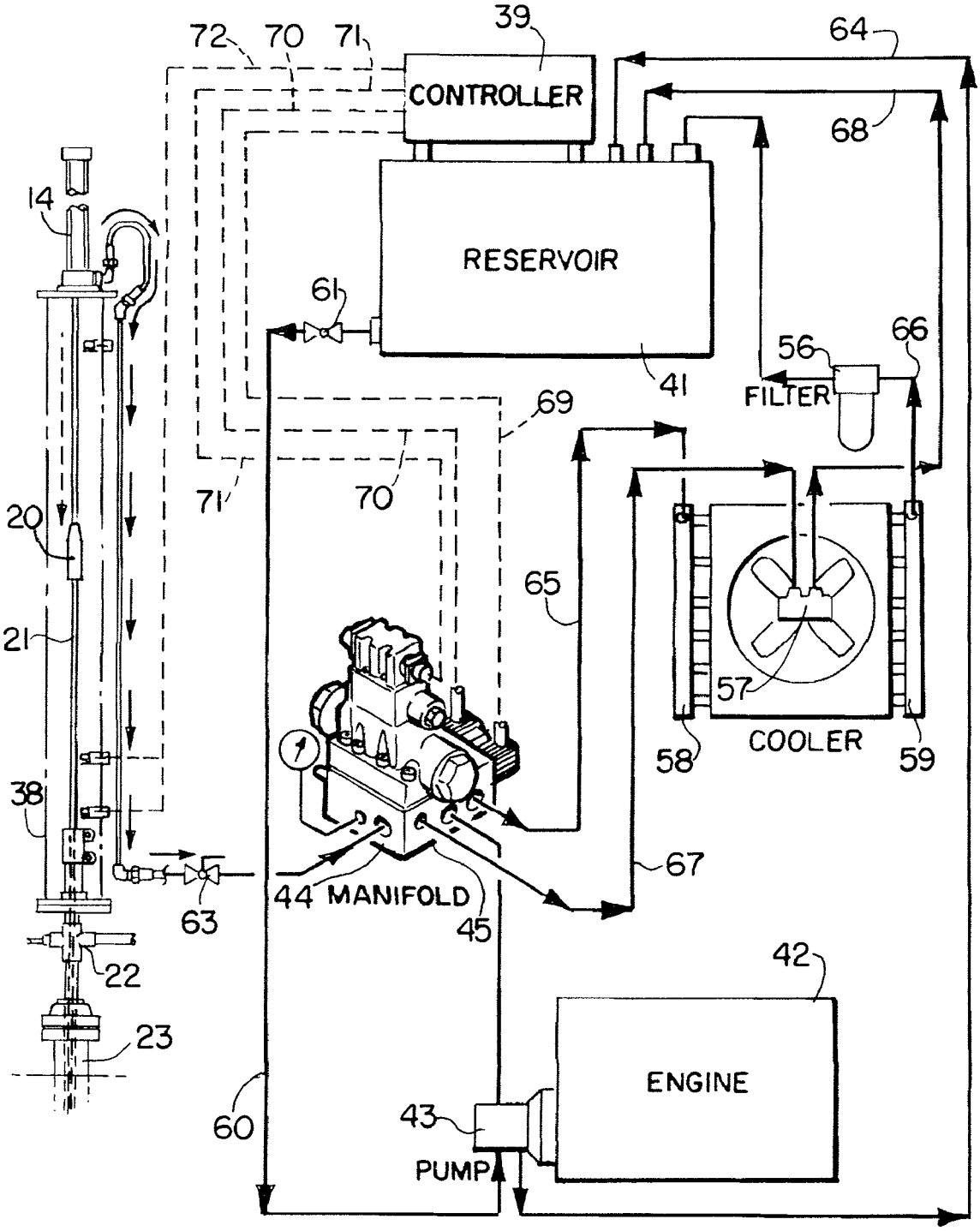

FIGS. 8-9 show a second embodiment of the apparatus of the present invention designated generally by the numeral 40 in FIGS. 14-16. The alternate embodiment of FIGS. 8-19 employs lift cylinder 14, rod 17, sucker rod 21, frame 38, coupling 20, proximity switches 24, 25, 26 of the preferred embodiment. In FIGS. 15, 16, oil well pump apparatus 40 provides a reservoir 41 for containing a hydraulic fluid to be used for operating manifold 44 and lift cylinder 14. A prime mover such as engine 42 operates compensating pump 43. The pump 43 pumps hydraulic fluid under pressure via flow line 62 to inlet 51 (see FIG. 12) of manifold 44 fluid transfer block 45. Fluid then exits fluid transfer block 45 via outlet 53 (see FIG. 13) for communicating with lift cylinder 14. Notice in FIG. 16 that flow is reversed in line 63 when the lift cylinder 14 is being emptied of hydraulic fluid, when the pushrod 17 is falling. In FIG. 16, fluid is discharged via outlet 52 (see FIG. 12) and flows through flow line 65 (see FIG. 16) to inlet of cooler 55. Hydraulic fluid continues in flow line 66 through filter 56 until it empties into reservoir 41.

In FIGS. 8-13 and 17-19, manifold 44 is shown in more detail. The lower end portion of manifold 44 provides fluid transfer block 45 which is fitted with directional valve 46, proportioning valve 47, relief valve 48, bypass valve 49 and fan flow control 50. It should be understood that the directional valve 46, proportional valve 47, relief valve 48, function in the same manner as they function with respect to the preferred embodiment of FIGS. 1-7 wherein they are designated by the numerals directional valve 28, proportioning valve 31, and relief valve 37.

Valves 46, 47, 48 can be controlled with a programmable logic controller or "PLC" controller 39. Fluid transfer block 45 can be provided with a gauge port 54 that can be used to monitor pressure within the fluid transfer block 45.

Instrumentation lines 69, 70, 71, 72 are provided that enable controller 39 to communicate with and control the valves 46, 47, 48 and 49. Instrumentation line 69 enables PLC 39 to control bypass valve 49. The valve 49 is a bypass valve that can be used to transfer fluid from pump 43 through line 62 to fluid transfer block 45 and then to reservoir 41 via flow lines 65, 66. The flow line 66 can be provided with a filter 56 for filtering any foreign matter from the hydraulic fluid contained in the system 40.

Pump 43 receives hydraulic fluid from reservoir 41 via flow line 60 and its valve 61. Instrumentation line 70 enables PLC 39 to control proportional valve 47. Instrumentation line 71 enables PLC 39 to control directional valve 46.

The manifold 44 eliminates friction and maintenance of hoses or the like. The bypass valve 49 of the alternate embodiment is a feature that enables the prime mover 42, pump 43 and hydraulic fluid being pumped from reservoir 41 to warm up for a period of time (e.g. 2-30 minutes) before beginning to operate lift cylinder 14. Otherwise, the lift cylinder 14 can be operated with three switches 24, 25, 26 of the preferred embodiment of FIGS. 1-7 and in the same manner using valve 46,47,48 which can be the same valves (e.g. Parker brand) as valves 28, 31, 37 respectively of the preferred embodiment.

Block 44 is provided with channels (phantom lines FIGS. 17-19) that interconnect ports 50, 51, 52, 53, 54 and valves 47, 48, 49.

Figure 17:
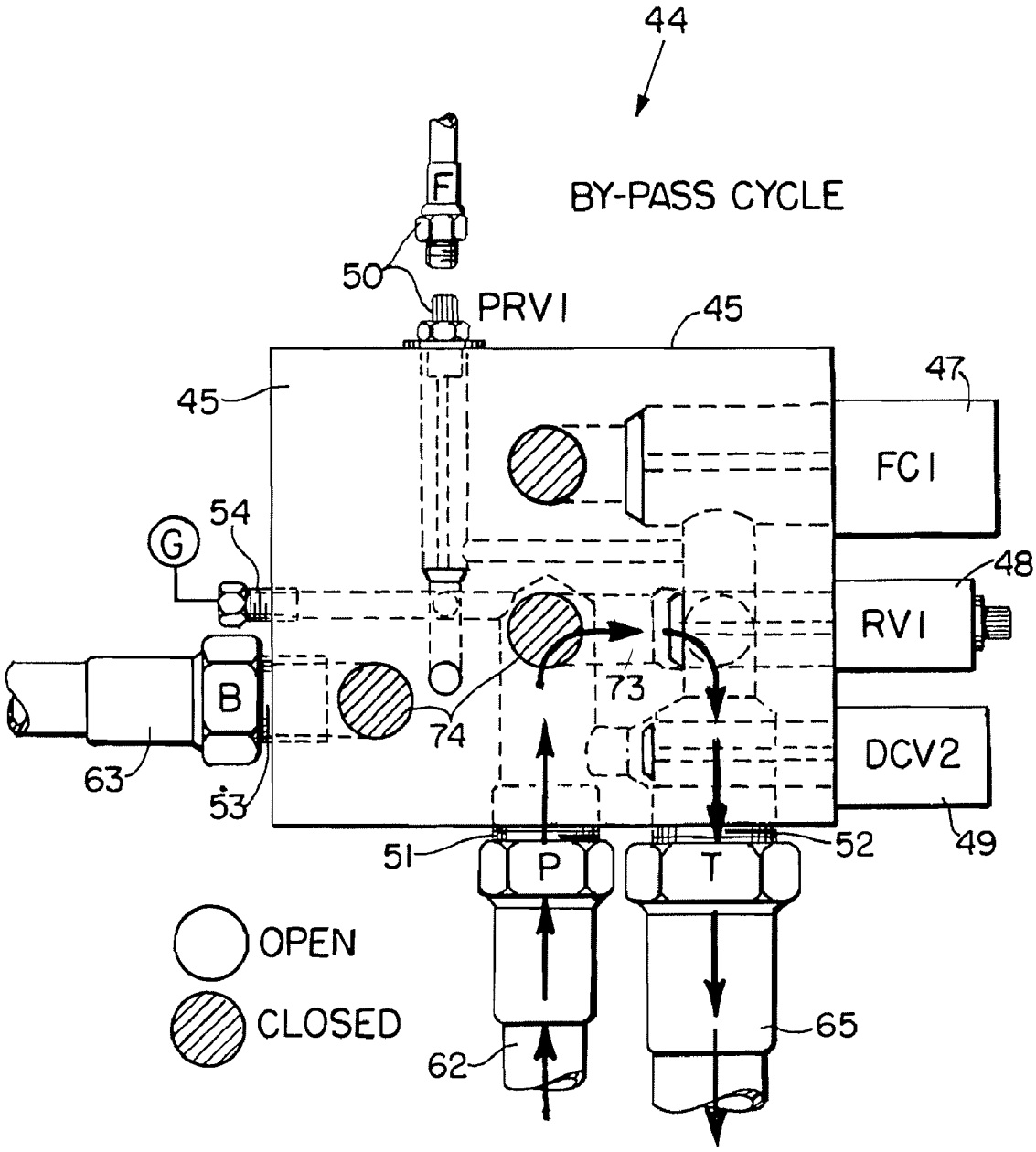
FIG. 17 is a fragmentary view of the alternate embodiment of the apparatus of the present invention showing the manifold in a bypass condition.

In FIG. 17, block 45 is shown in detail in the bypass position PLC controller 39 is used to operate bypass valve 49 so that fluid flows from line 62 to port 51 and then to port 52 and line 65 via channel 73 of block 44.

Figure 18:
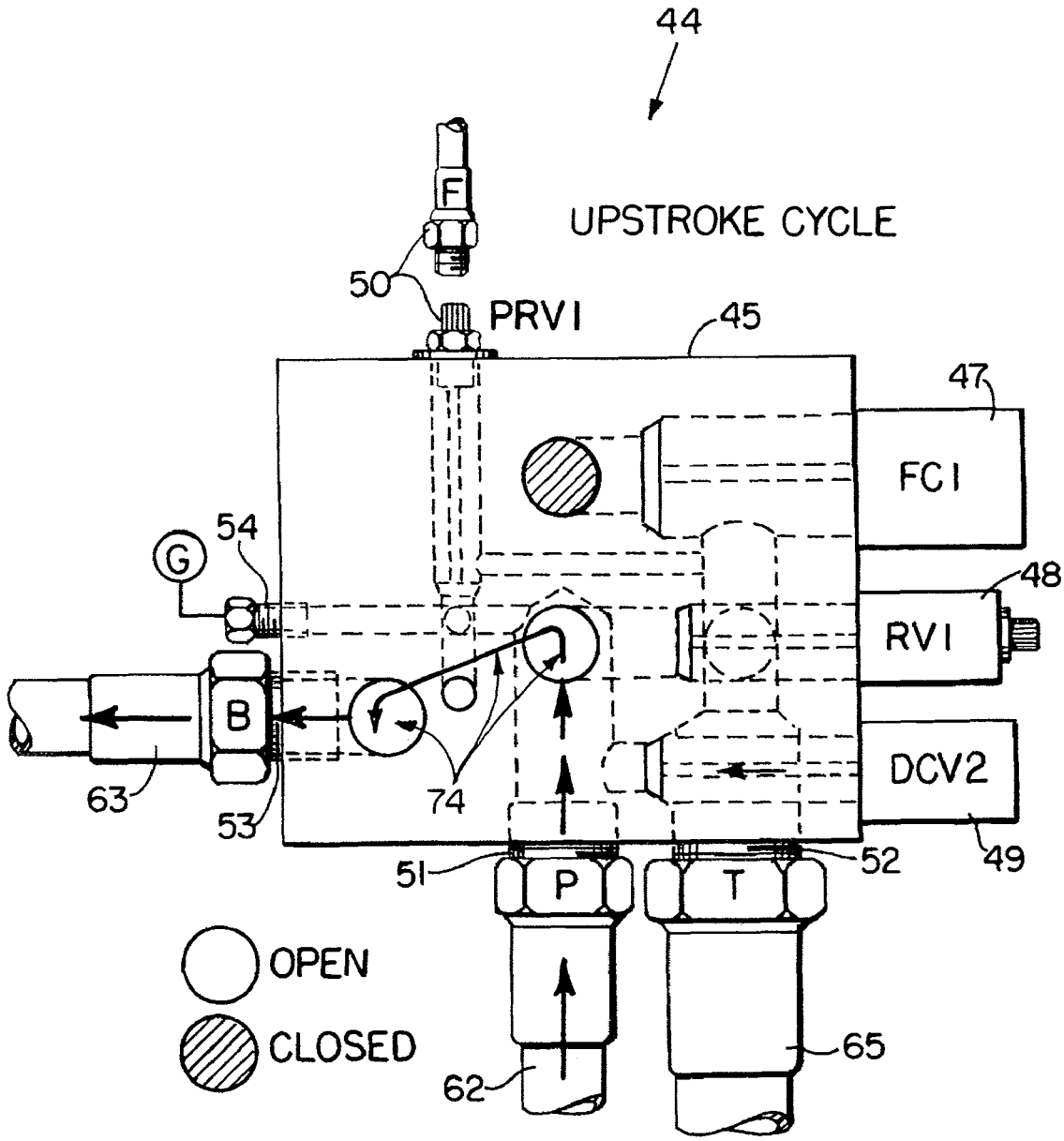
FIG. 18 is a fragmentary view of the alternate embodiment of the apparatus of the present invention showing the manifold in an upstroke position.

In FIG. 18, the upstroke cycle is shown wherein a channel 74 in block 44 connects inlet 51 and flow line 62 to outlet 53 and flow line 63 so that hydraulic fluid can be pumped under pressure to cylinder 14 for uplifting the rods 17, 21.

Figure 19:
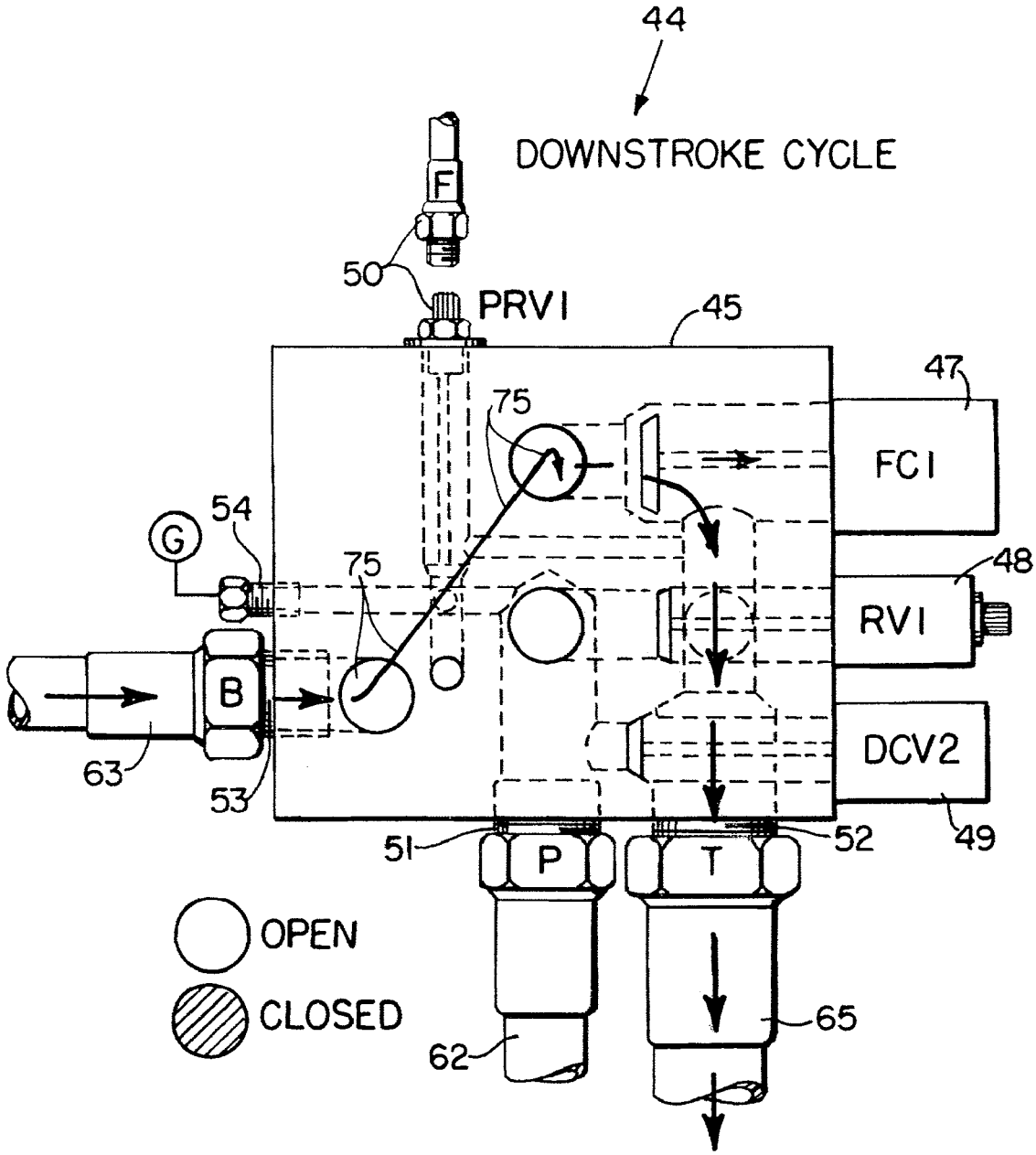
FIG. 19 is a fragmentary view of the alternate embodiment of the apparatus of the present invention showing the manifold in a downstroke position.
Figure 20:
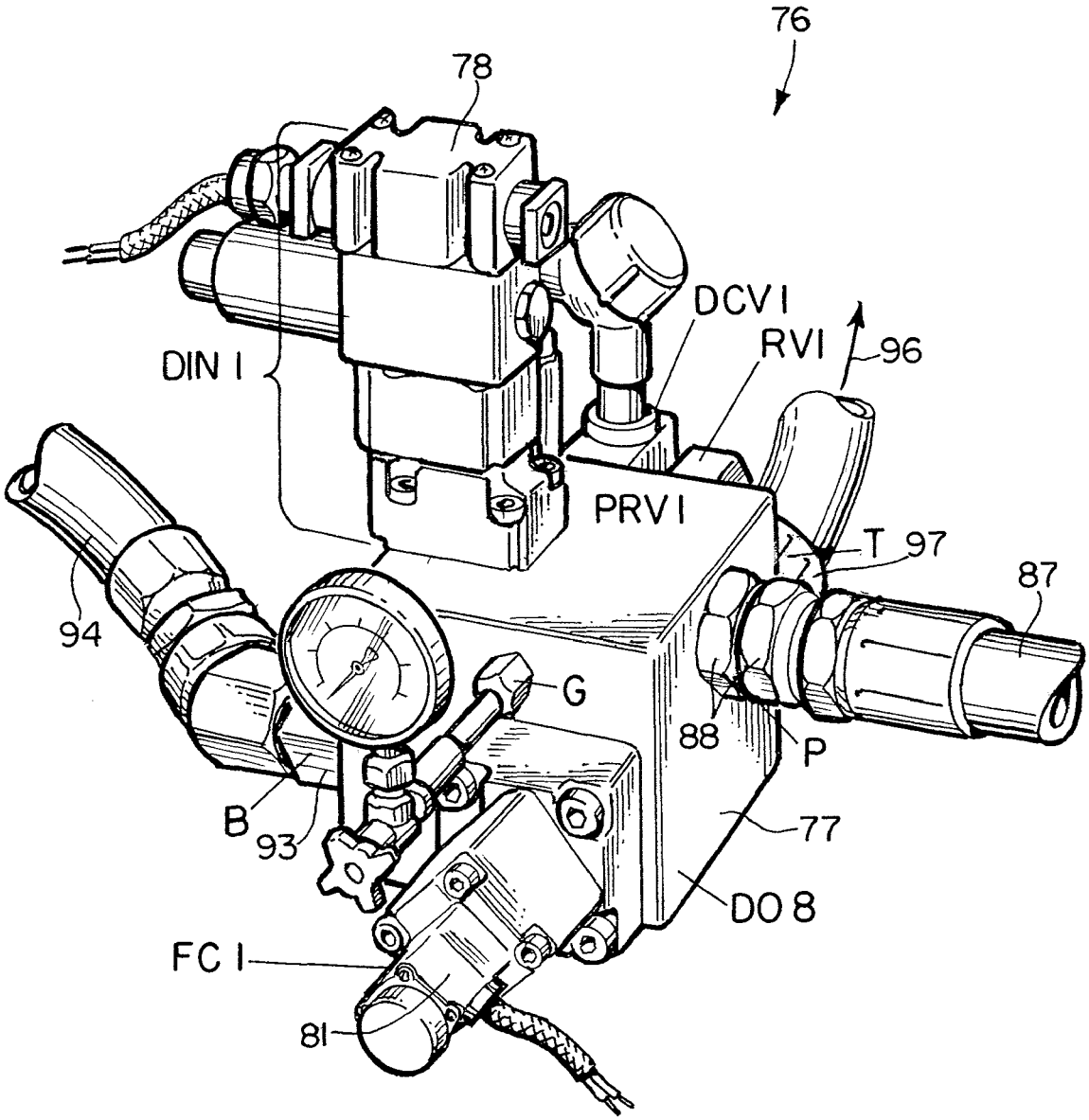
FIG. 20 is a partial perspective view of the preferred embodiment of the apparatus of the present invention showing an alternate manifold construction.

In FIG. 19, the downstroke cycle is shown wherein inlet 51 is closed and hydraulic fluid empties from cylinder 14 via flow line 63, outlet 53 and a channel 75 of block 44 that is fluid communication with flow line 65. In FIG. 19, the proportioning valve 47 gradually meters flow back to reservoir via flow line 65 and channel 75.

FIGS. 20-28 show an alternate configuration for the manifold, designated generally by the numeral 76. It should be understood that the manifold 76 will be used in combination with a reservoir 11, prime mover 12 (for example, engine), compensating pump 13, hydraulic lift cylinder 14, and pumping string/sucker rod 21 of the embodiments of FIGS. 1-19.

In FIGS. 20-28, a slightly different valving arrangement is provided that utilizes a poppet valve having a conically shaped valving member.

Manifold 76 provides a fluid transfer block 77. Attached to the fluid transfer block 77 as shown in FIGS. 20-28 are a directional valve block 78 and a proportional throttle valve block 80. The directional valve block 78 carries a directional valve assembly 79 that includes poppet valve 85 with a conically shaped valving member 100. The proportional throttle valve block 80 carries a proportional throttle valve 81. The fluid transfer block 77 supports a relief valve 82, bypass valve 83, fan flow control valve 84, poppet valve 85, and shuttle valve 86. The operation of the manifold 76 shown in FIGS. 20-24 is similar to the operation of the alternate embodiment of FIGS. 8-19 in that the manifold 76 and its various valves can be preferably controlled with a programmable logic controller or PLC and the instrumentation shown in FIGS. 21-22.

Figure 21:
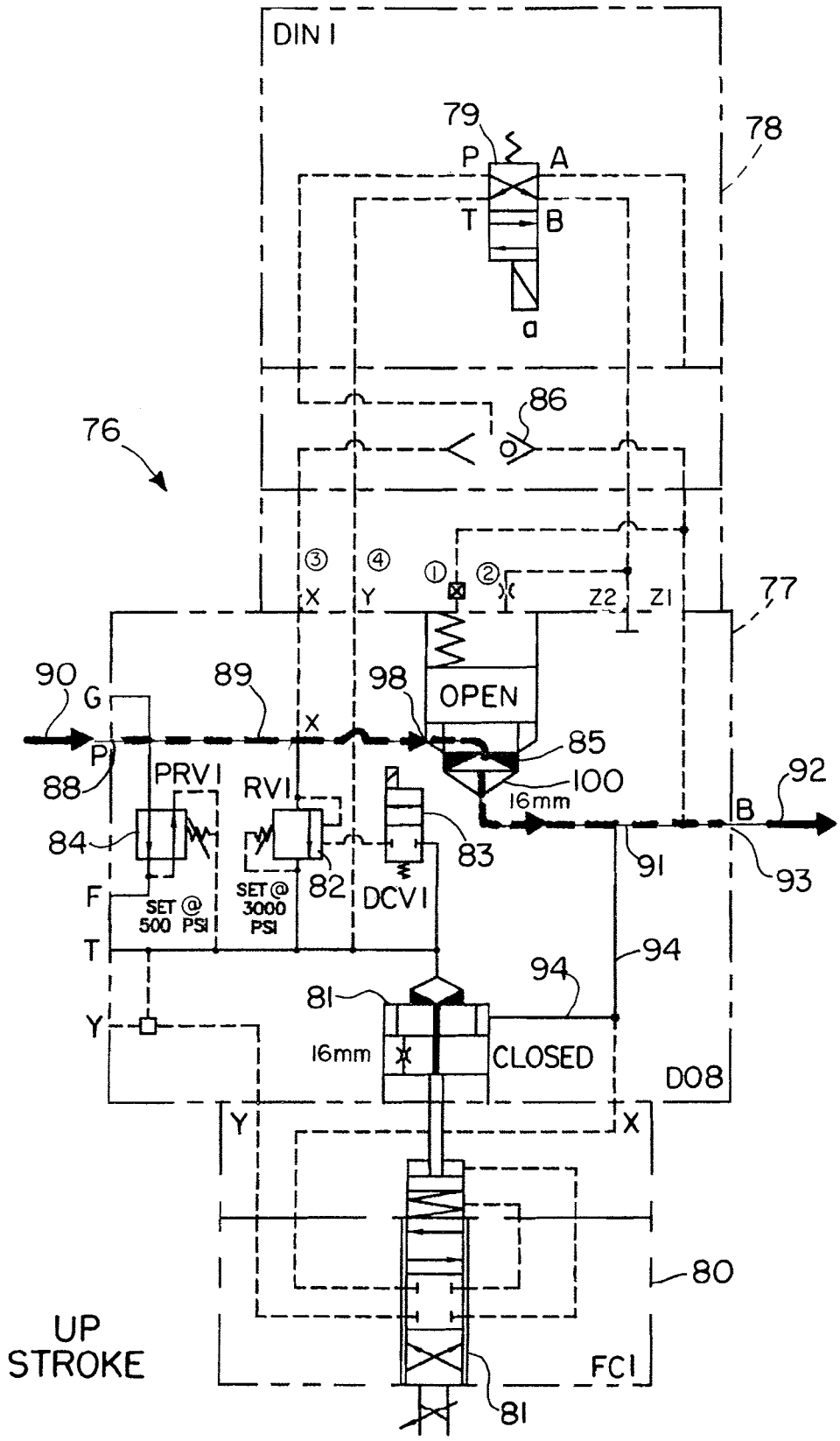
FIG. 21 is a schematic diagram of the preferred embodiment of the apparatus of the present invention showing the alternate manifold arrangement.
Figure 23:
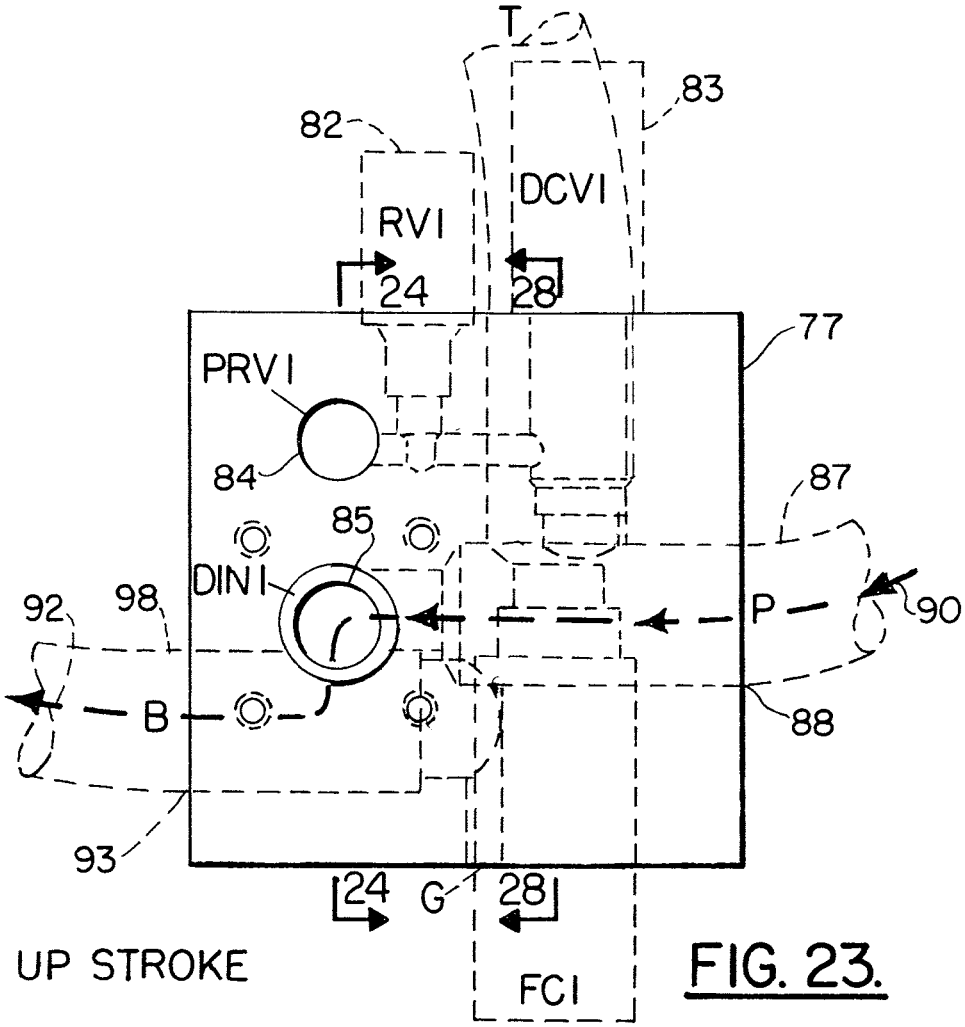
FIG. 23 is a fragmentary view of the manifold of FIGS. 21 and 22.
Figure 24:
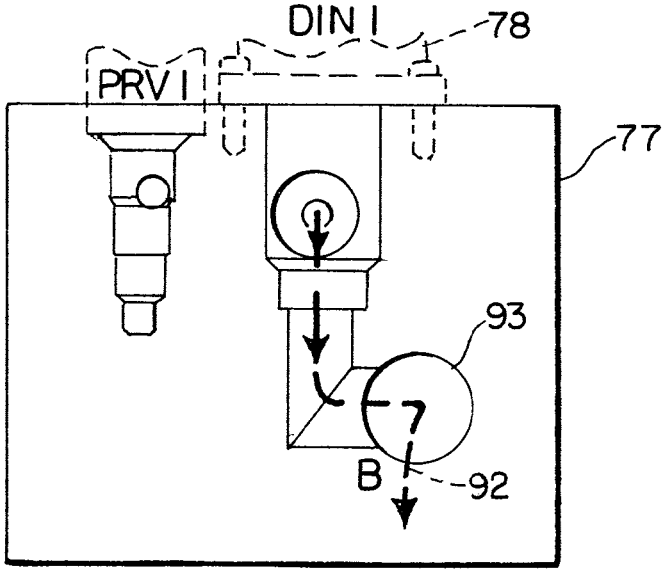
FIG. 24 is a fragmentary view of the manifold of FIGS. 21 and 22.
Figure 25:
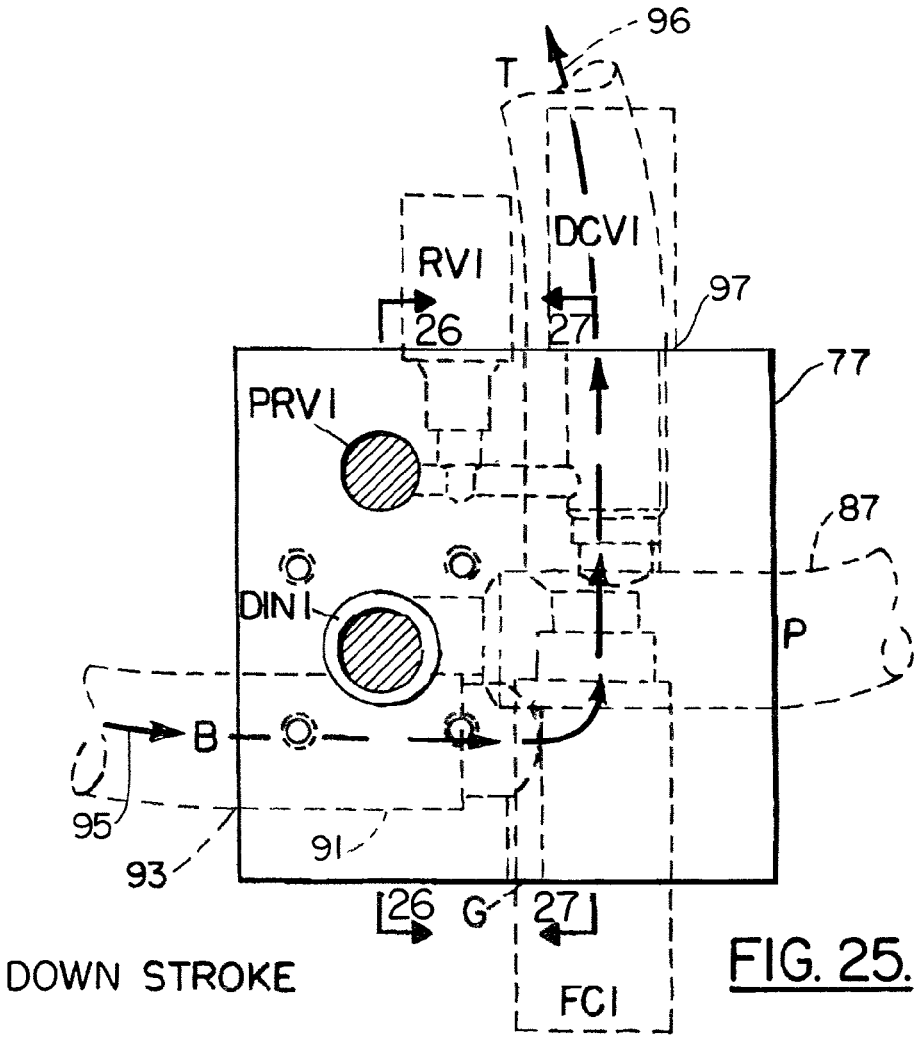
FIG. 25 is a fragmentary view of the manifold of FIGS. 21 and 22.
Figure 26:
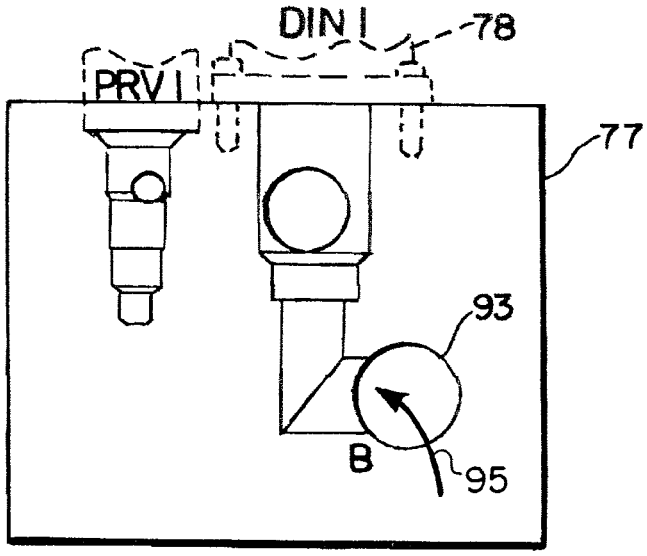
FIG. 26 is a fragmentary view of the manifold of FIGS. 21 and 22.
Figure 27:
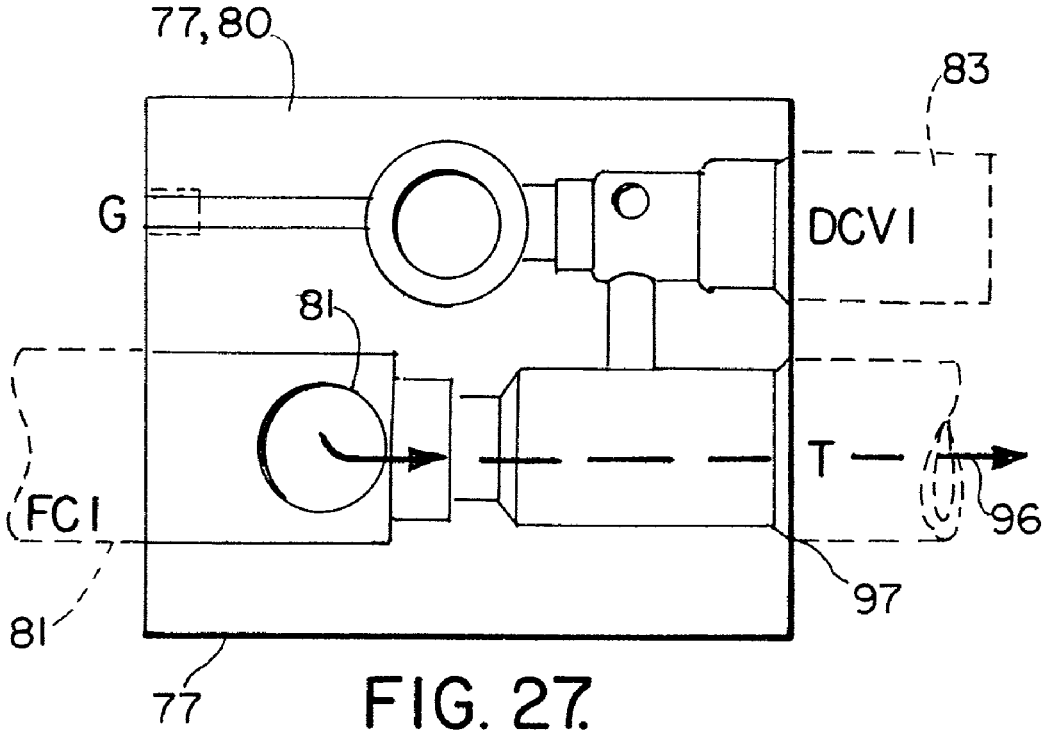
FIG. 27 is a fragmentary view of the manifold of FIGS. 21 and 22.
Figure 28:
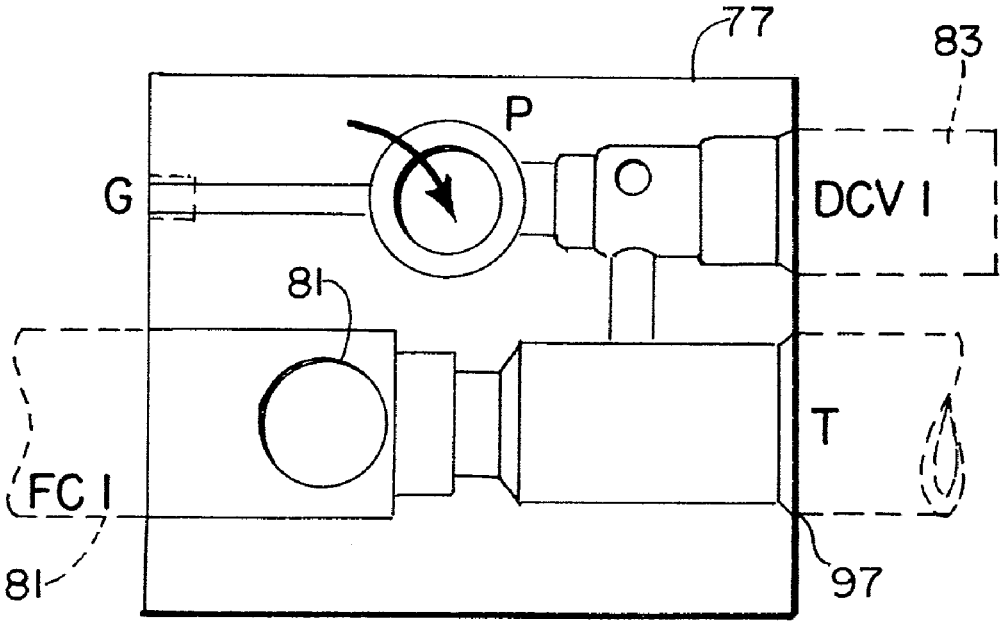
FIG. 28 is a fragmentary view of the manifold of FIGS. 21 and 22.

FIGS. 21, 23 and 28 illustrate an upstroke orientation for manifold 76, as when the hydraulic lift cylinder 14 and pumping string/sucker rod 21 are being elevated. In FIGS. 21 and 23, block 77 provides an inlet fitting 88 fitted with a flow line 87. Flow line 89 connects inlet fitting 88 with outlet fitting 93 as shown in FIG. 21. In FIG. 21, poppet valve 85 is open thus allowing fluid flow from inlet fitting 88 through flow line 89 to valve 85 and then to outlet fitting 93 via flow line 91. In FIG. 21, the proportional throttle valve 81 is closed. Thus, flow line 94 is also closed.

In FIGS. 22, 25, 26, 27 a downstroke condition is shown. Poppet valve 85 is closed using a PLC or programmable logic controller. The proportional throttle valve 81 is opened using the PLC controller. Valve 81 can provide a conically shaped valving member 101. Valve 81 works in combination with the limit switches 24, 25, 26. When the prime mover 12 operates compensating pump 13, pressure is generated in flow line 87 that attaches to block 77 at inlet fitting 88. This pressurized hydraulic fluid travels via flow lines 89, 91 to outlet fitting 93 and then via flow line 98 to the hydraulic lift cylinder 14.

Figure 22:
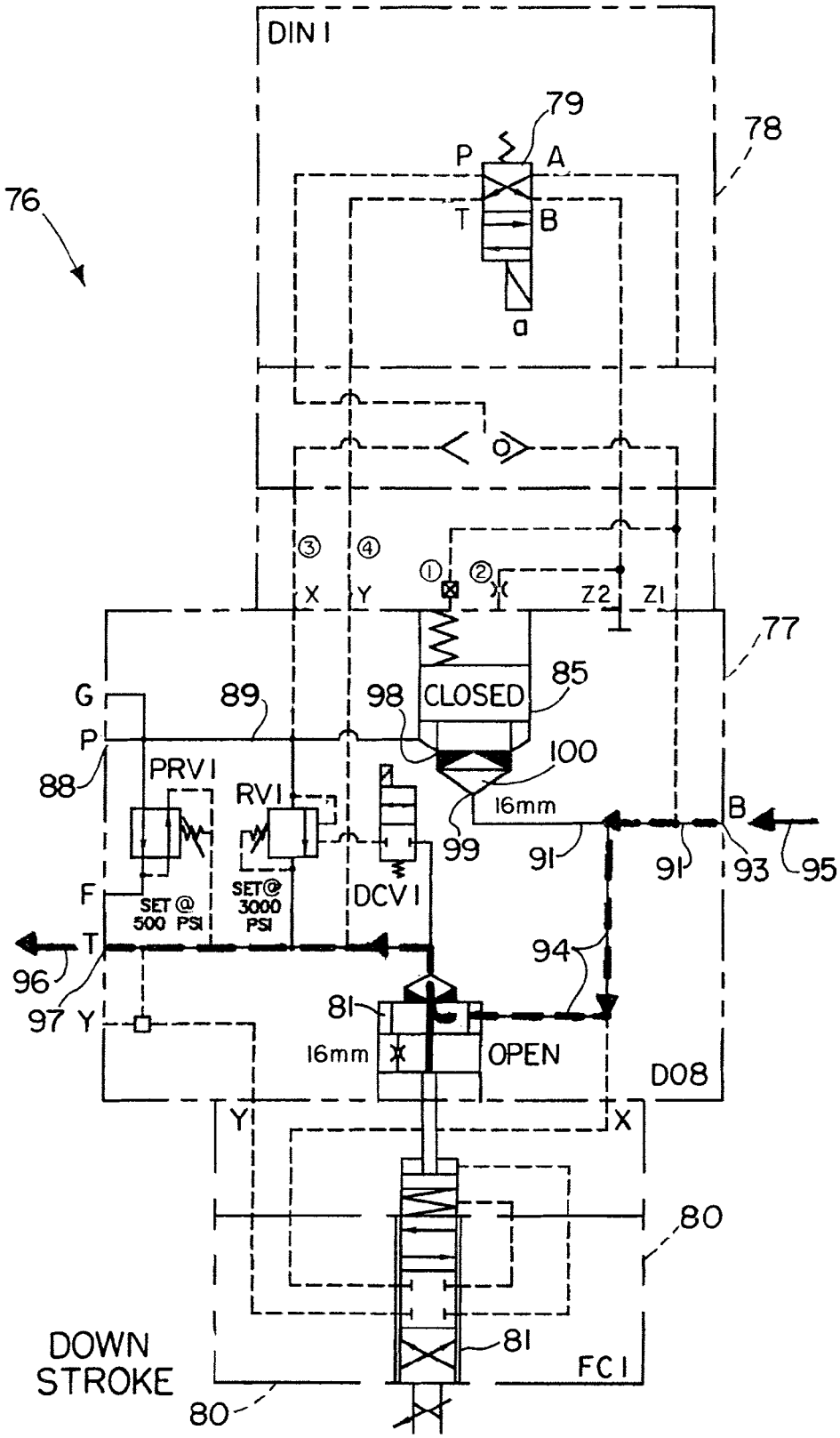
FIG. 22 is a schematic diagram of the preferred embodiment of the apparatus of the present invention showing the alternate manifold arrangement.

When the hydraulic lift cylinder 14 reaches an uppermost position, coupling 20 trips the uppermost limit switch 24. The limit switch 24 activates the programmable logic controller to begin closing valve 85 and opening valve 81. The valve 81 is a proportional throttle valve that opens a desired percentage of opening as controlled by the programmable logic controller. In FIG. 22, valve 85 has been closed. The valve 81 has opened allowing hydraulic fluid in cylinder 14 to travel through a return flow line to block fitting 93 and then to flow lines 91, 94 as shown in FIG. 22 exiting fitting 97. This hydraulic fluid then travels via flow line as indicated by arrow 96 in FIG. 22 to the reservoir 11.

When the falling pumping string/sucker rod 21 is lowered so that coupling 20 reaches the second lowest limit switch 25, valve 81 can begin to throttle or close so that the rate of descent of the pumping string/sucker rod 21 is slowed. When the coupling 20 reaches the lowest proximity or limit switch 26, the valve 81 is closed and the valve 85 is opened so that the cycle repeats.

Valve 85 provides a conically shaped or tapered valving member 100. Thus, fluid traveling from the pump 13, flow line 87 and inlet fitting 88 reaches block 77 and then travels via flow line 89 to inlet 98. The outlet 99 enables fluid to travel through valve 85 to flow line 91. The tapered shape of valving member 100 eliminates any surge as the gradually tapering valving member 100 moves in relation to inlet 98 as it is opened.

Relief valve 82 can be used to protect the system from overpressure. Valve 84 can be used to control the cooling from motor. Shuttle valve 86 can be used to control flow of instrumentation fluid to directional valve 79 (see FIGS. 21, 22).

The poppet valve 85 can be for example a Parker Hannifin valve (part number D1VW020HNKCG). The proportional throttle valve can be a Parker Hannifin valve (part number TDA025EW09B2NLW).

FIGS. 29-34 show another alternate embodiment of the apparatus of the present invention, designated generally by the numeral 102. As with the preferred embodiment, oil well pump 102 employs a reservoir 11, compensating pump, prime mover to power pump 103 (e.g. engine), hydraulic lift cylinder 14, cylinder rod 17, coupling 20, sucker rod or pumping string 21, frame 38, limit switches 24, 25, 26 and a controller (such as for example a programmable logic controller 39). In the embodiment of FIGS. 29-34, a controller 39 such as a programmable logic controller or "PLC" can be used to control the up-stroke and downstroke of the hydraulic cylinder 14 cylinder rod 17. Frame 38 can be provided to support limit switches 24, 25, 26 and lift cylinder 14, as with the embodiments of FIGS. 1-28.

In FIGS. 29-34 a pump 103 is a compensating pump, such as a variable volume pump as seen for example in U.S. Pat. No. 3,726,093 entitled "Pump Control System" and assigned to Parker Hannifin Corporation which is hereby incorporated herein by reference. Pump 103 can be for example a Parker model hydraulic piston pump model PAVC100B2R422. The pump 103 has a cam plate or swash plate 110 that can be placed in different positions for controlling flow as is described in the '093 patent (see FIG. 1 of U.S. Pat. No. 3,726,093 and accompanying text. The directional control valve of the '093 patent is of the four-way closed center type for controlling the actuation of a double acting fluid motor and comprises the housing having a bore intersected axially therealong by the inlet port, by a pair of motor ports and by a pair of return ports. The motor ports are communicated with the ports of the fluid motor by way of check valves one of which opens when the associated motor port is pressurized and the other of which is cam-opened when the associated motor port is communicated with the adjacent return port.

All control is achieved by the proper positioning of the swash plate 110. This is achieved by servo piston 119 acting on one end of the swash plate 110 working against the combined effect of the off-setting forces of the pistons 120 and a centering spring on the other end. The control spool 123 acts as a metering valve which varies the pressure behind the servo piston 119.

The amount of flow produced by pump 103 is dependent upon the length of stroke of the pumping pistons 120. This length of stroke, in turn, is determined by the position of the swash plate 110. Maximum flow is achieved at an angle of about 17 degrees.

The rotating piston barrel 121, driven by the prime mover and drive 108, moves the pistons 120 in a circular path and piston slippers are supported hydrostatically against the face of the swash plate 110. When the swash plate 110 is in a vertical position (FIG. 34), perpendicular to the centerline of the piston barrel 121, there is no piston stroke and consequently no fluid displacement. When the swash plate 110 is positioned at an angle (FIG. 33), the pistons 120 are forced in and out of the barrel 121 and fluid displacement takes place. The greater the angle of the swash plate 110, the greater the piston 120 stroke.

Figure 33:
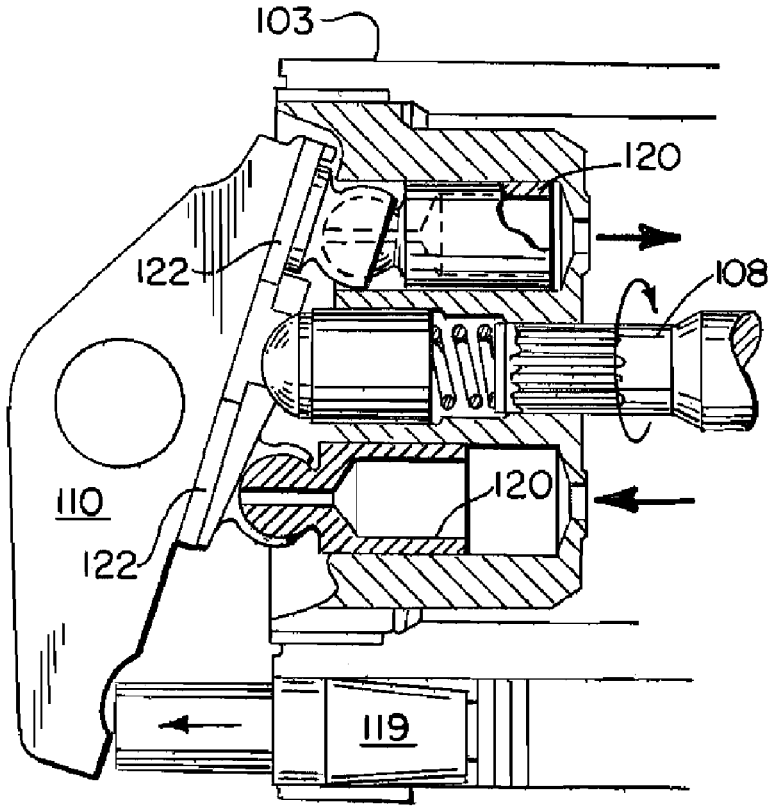
FIG. 33 is a fragmentary diagram of another alternate embodiment of the apparatus of the present invention in the up stroke position.
Figure 34:
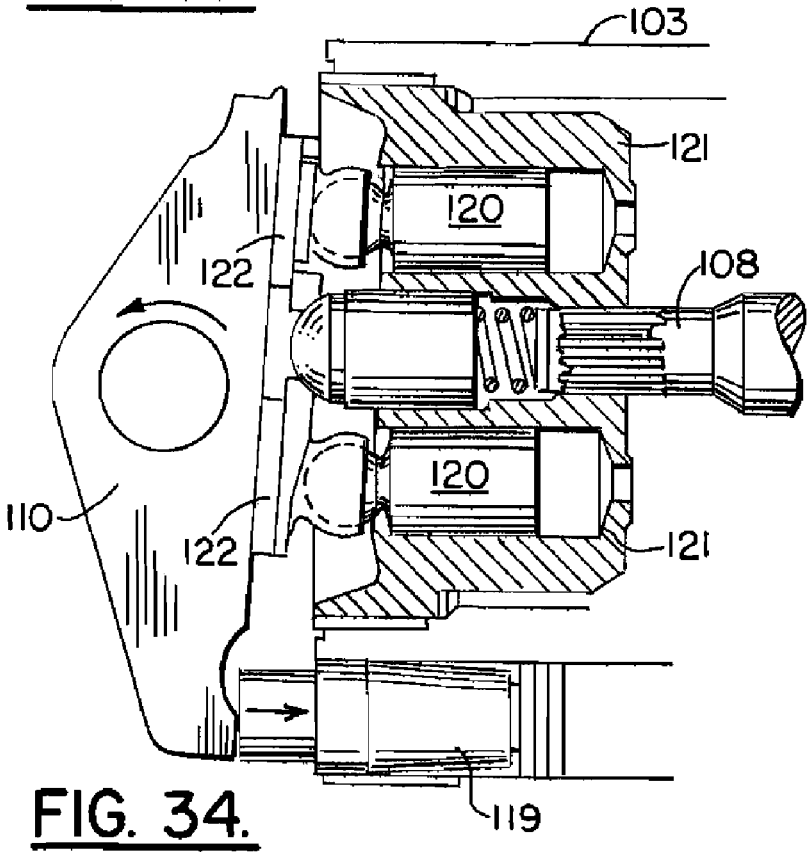
FIG. 34 is a fragmentary diagram of another alternate embodiment of the apparatus of the present invention in the down stroke position.
Figure 35:
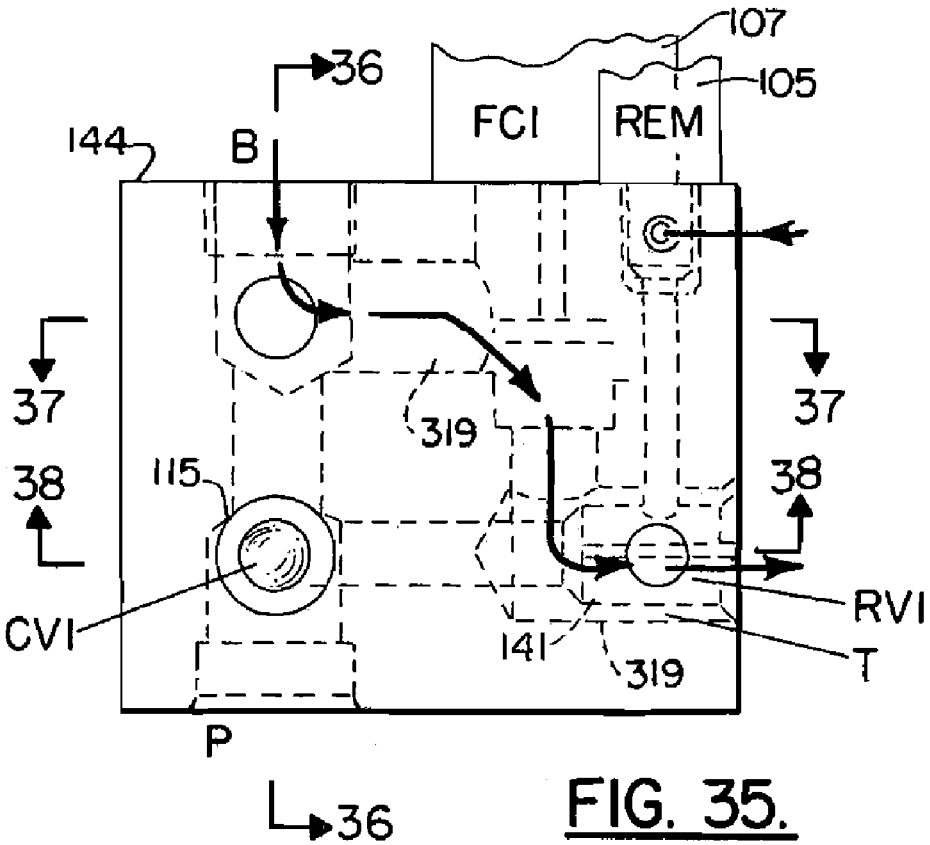
FIG. 35 is a top fragmentary view of a manifold portion of the system of FIGS. 29-34, shown in the downstroke mode or position.
Figure 36:
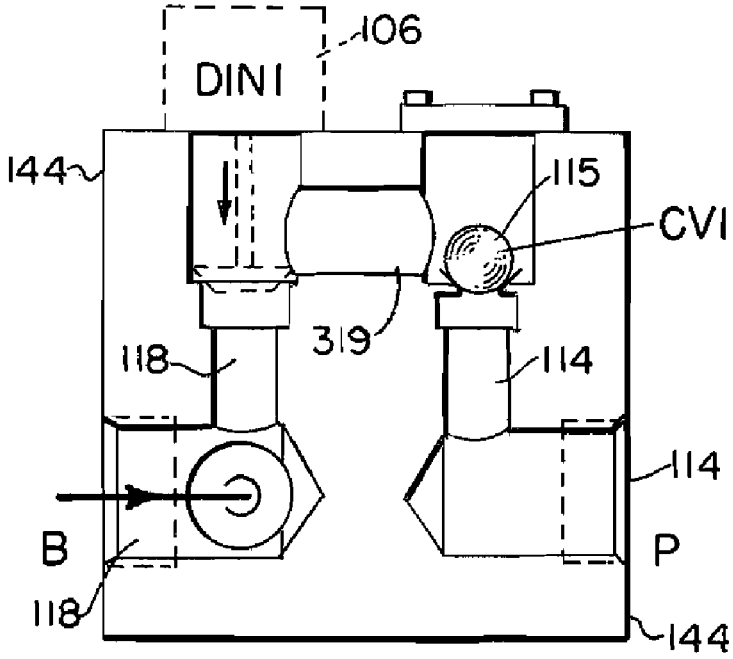
FIG. 36 is a sectional view taken along lines 36-36 of FIG. 35.
Figure 37:
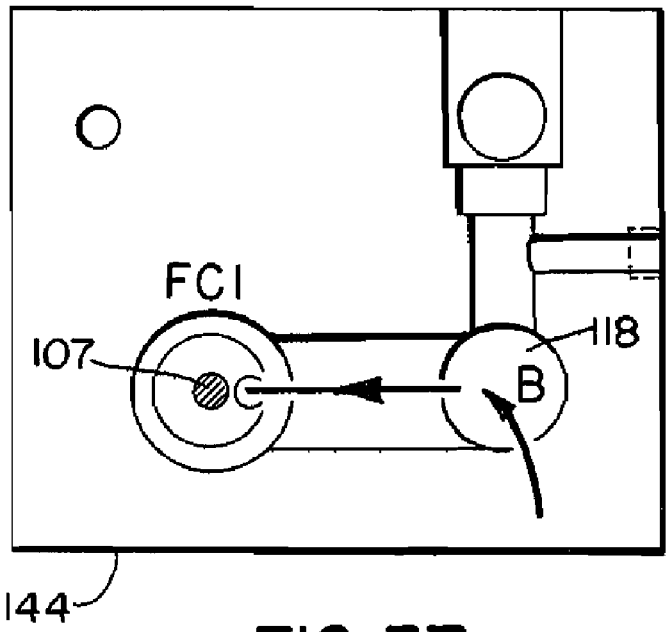
FIG. 37 is a sectional view taken along lines 37-37 of FIG. 35.
Figure 38:
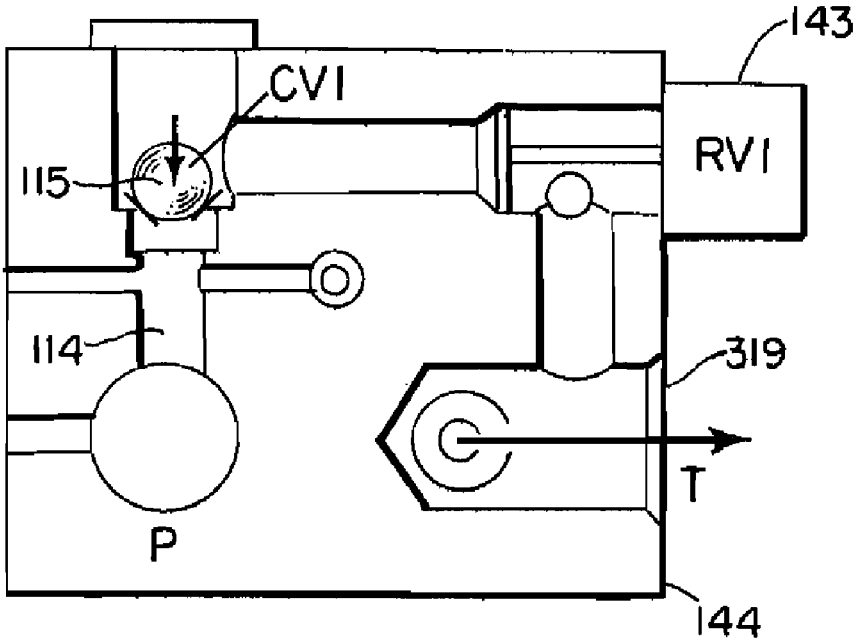
FIG. 38 is a sectional view taken along lines 38-38 of FIG. 35.
Figure 39:
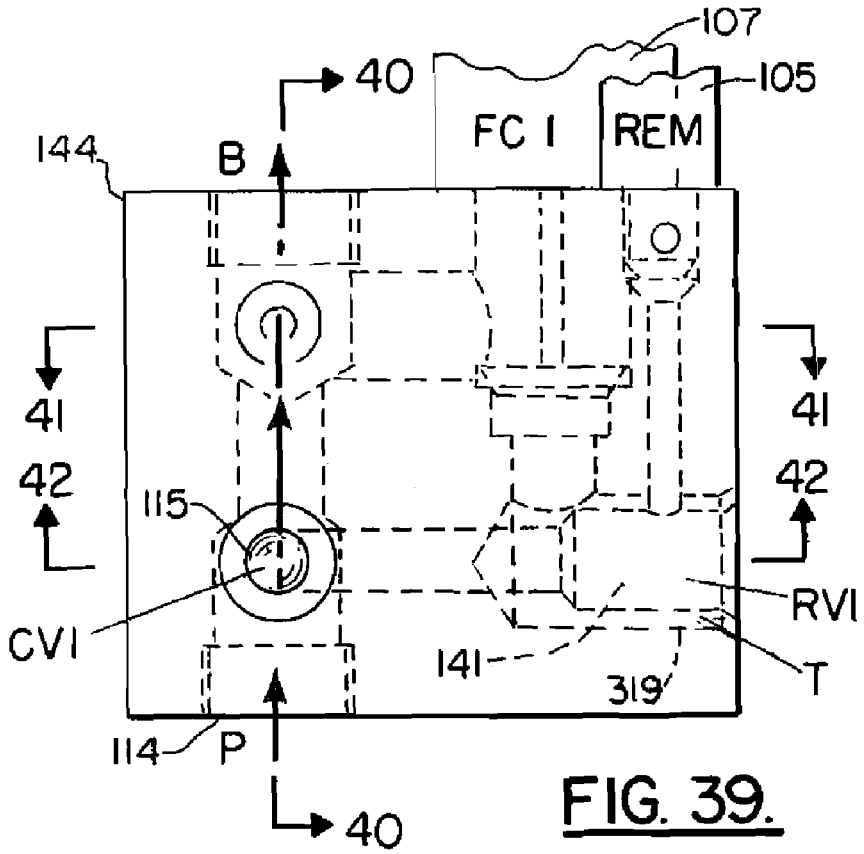
FIG. 39 is a top, plan view of the manifold of FIG. 35 shown in the upstroke mode or position.
Figure 40:
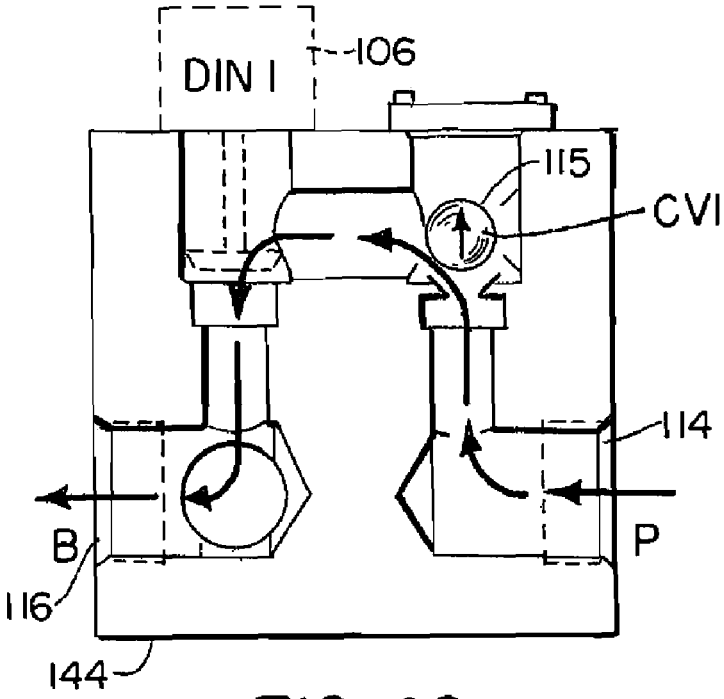
FIG. 40 is a sectional view taken along lines 40-40 of FIG. 39.
Figure 41:
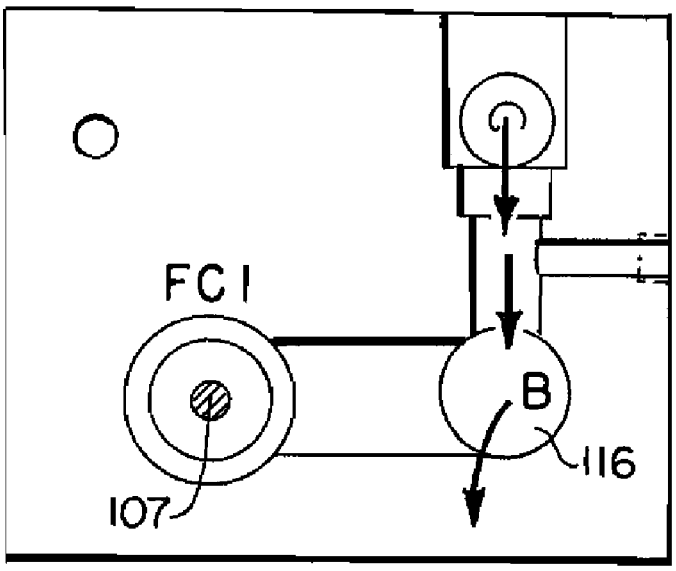
FIG. 41 is a sectional view taken along lines 41-41 of FIG. 39.
Figure 42:
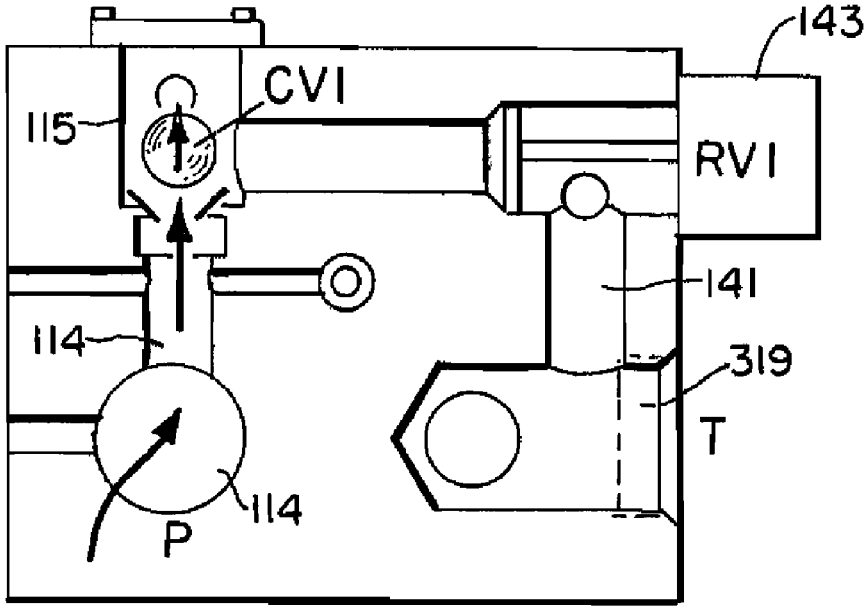
FIG. 42 is a sectional view taken along lines 42-42 of FIG. 39.

The centerline of the pumping piston assembly is offset from the centerline of the swash plate 110 as shown in FIGS. 33-34. Therefore, the pistons 120 effective summation force tends to destroke the swash plate 110 to a vertical (neutral) position. This destroking force is balanced as the swash plate 110 is angled by the force of the servo piston 119.

Figure 29:
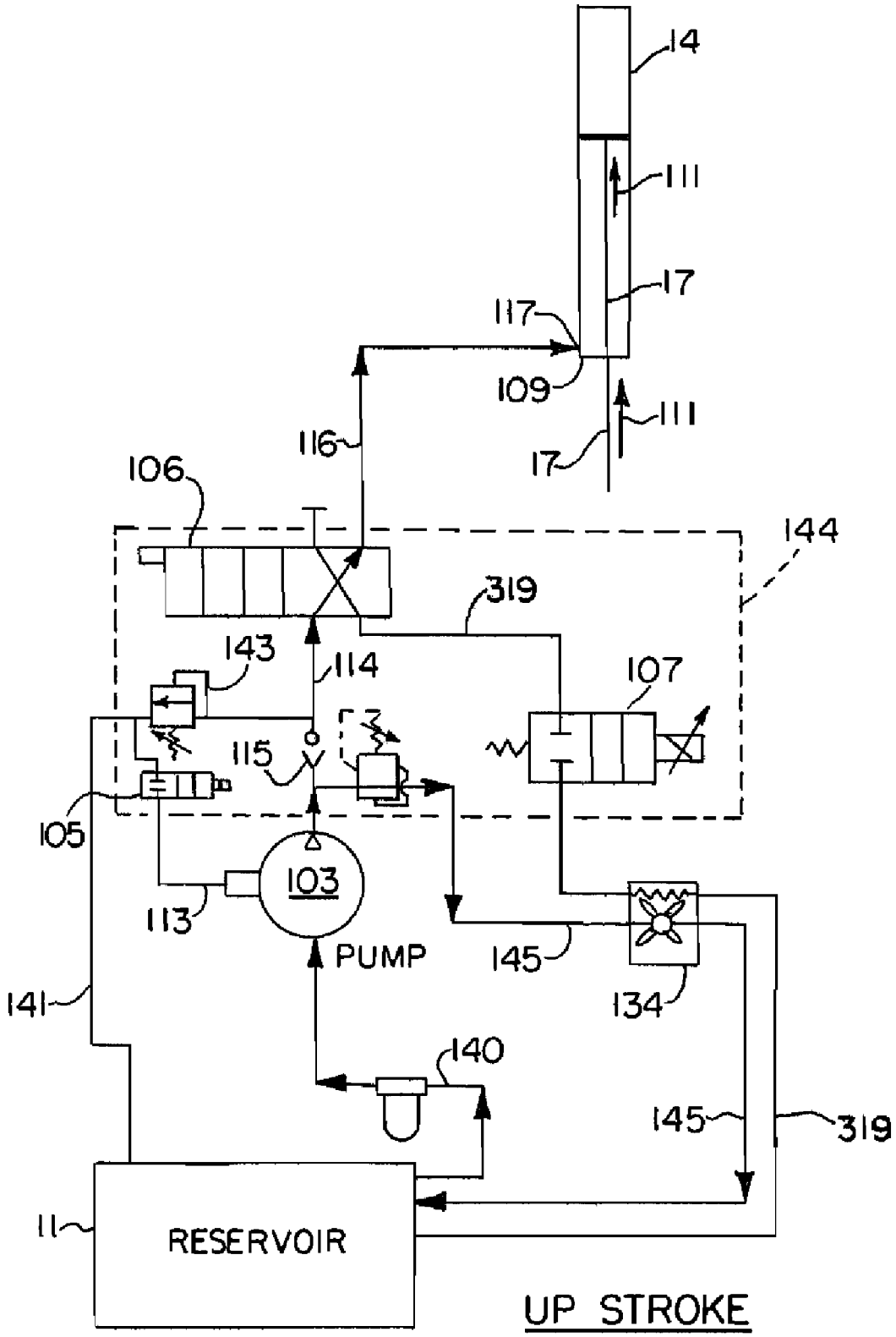
FIG. 29 is a schematic diagram of another alternate embodiment of the apparatus of the present invention in the up stroke position.
Figure 30:
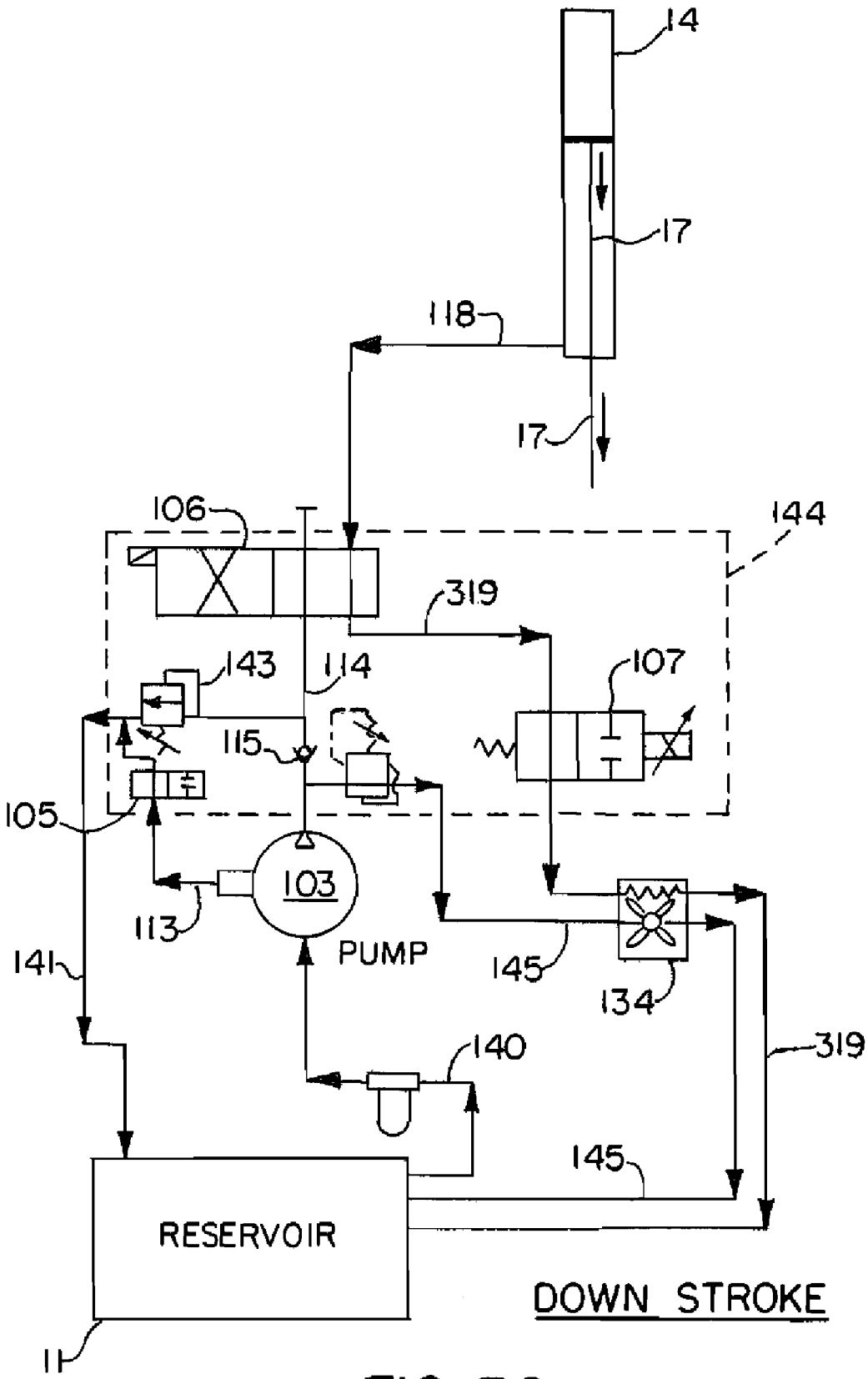
FIG. 30 is a schematic diagram of another alternate embodiment of the apparatus of the present invention in the down stroke position.
Figure 32:
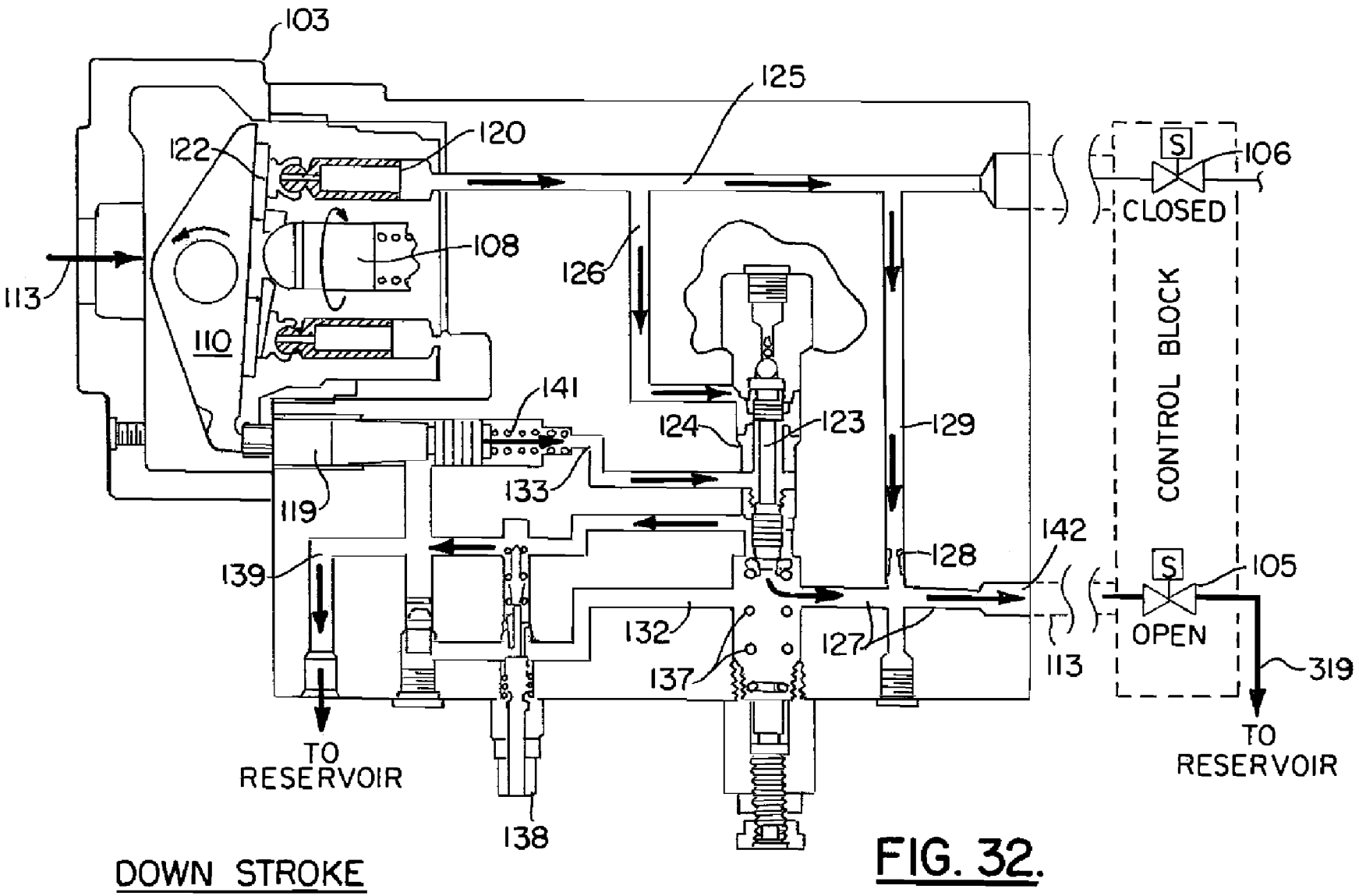
FIG. 32 is a fragmentary diagram of another alternate embodiment of the apparatus of the present invention in the down stroke position.

In FIG. 29, prior to starting a prime mover (electric motor, natural gas engine or diesel engine), a control valve (e.g. solenoid valve) 105 is energized to dump pump control signal, bringing the pump 103 to a minimum pressure (standby) position that is shown in FIGS. 32 and 34 (see arrow 104, FIG. 34). Any flow discharged from pump 103 travels via flow line 114 to reservoir 11. Hydraulic fluid does not flow in pump discharge line 114 because directional valve 106 is closed (FIG. 30). Flow line 114 can be provided with check valve 115 to prevent back flow from valve 106 to pump 103. When the prime mover is started, it rotates drive 108 and the hydraulic pump 103 turns up to a selected speed such as about 1800 RPM with the pressure still at standby (FIGS. 32, 34) as swash plate 110 is in the low pressure position of FIGS. 30 and 32. Pump 103 intakes hydraulic fluid from reservoir 11 via flow line 140. Excess pump pressure can be relieved using relief valve 143 that dumps excess pressure to reservoir 11 via flow line 141 or flow line 141 can empty into flow line 319 which then empties into reservoir 11.

Figure 31:
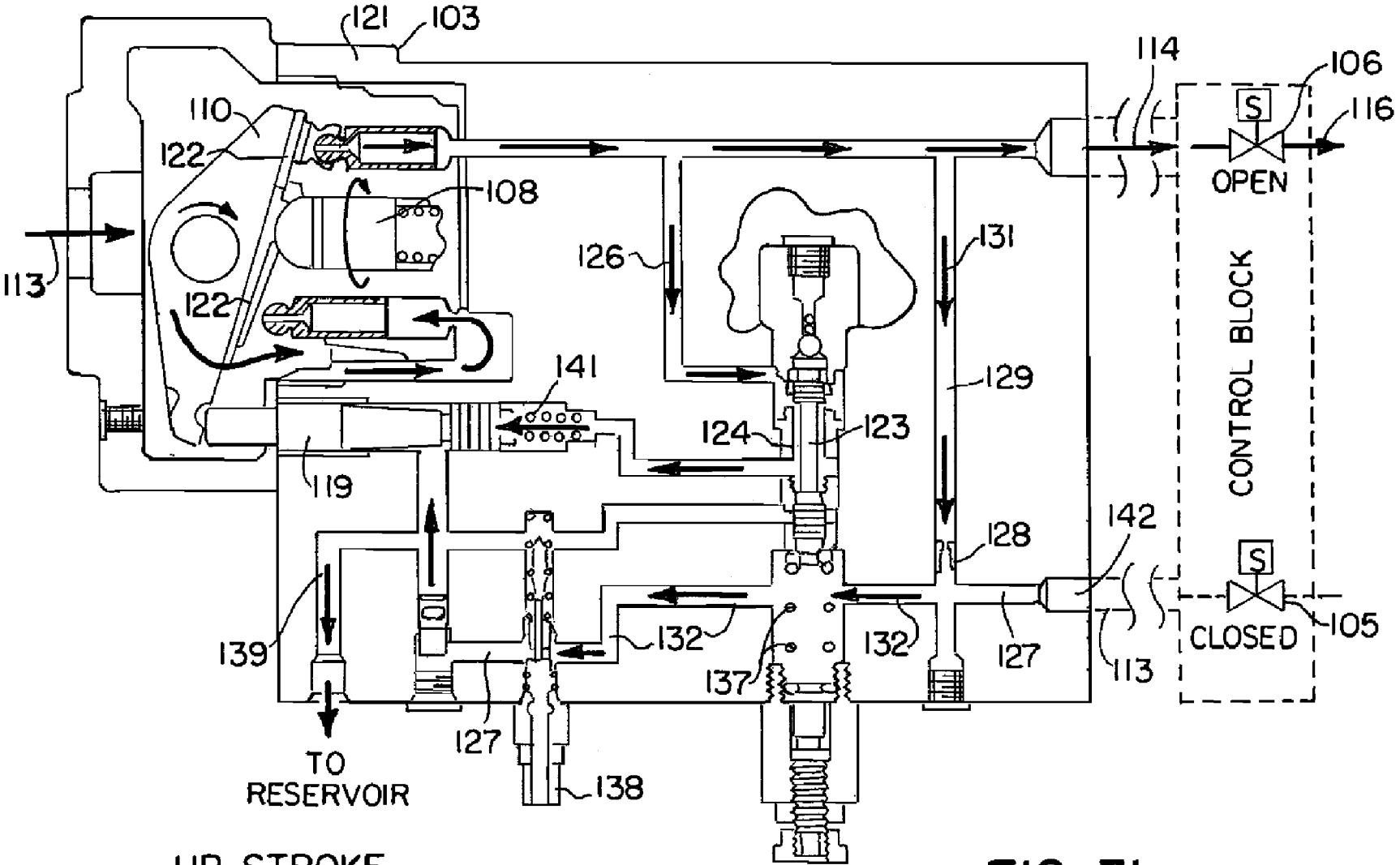
FIG. 31 is a fragmentary diagram of another alternate embodiment of the apparatus of the present invention in the up stroke position.

An up-stroke cycle (see FIGS. 31 and 33) begins by de-energizing the two position solenoid valve 105, closing flow line 113, enabling swash plate 110 to move to the position in FIGS. 29 and 31 and allowing pump 103 pressure to increase. The controller 39 energizes the directional valve 106 (see FIG. 29). When the directional valve 106 is energized, hydraulic fluid is directed via flow lines 114, 116 into the rod end 105 of the hydraulic cylinder 14 at 117 (see FIG. 29).

The rod 17 will elevate or retract (see arrows 111, FIG. 29) until an upper proximity switch 24 is actuated by the coupling 20 on the rod 17. Proximity switch 24 then signals controller 39 to de-energize the directional valve 106 thus halting the flow of hydraulic fluid in flow lines 114, 116 to cylinder 14. Proximity switch 24 sends a signal to controller 39 which signals the proportional flow control valve 107 to open to a point at which hydraulic fluid discharges via lines 118, 319 to reservoir 12.

The cylinder rod 17 will lower or extend at a desired velocity and until the coupling 20 reaches second proximity switch 25 positioned a selected distance (e.g. approximately one foot, or 0.30 meters) from the bottom travel of the rod 17. The current signal to the proportional valve 107 will then be decreased and it closes further, forcing the cylinder rod 17 and attached pumping string or sucker rod 21 to decelerate, until the coupling 20 lowers further and reaches third proximity switch 26. At that point, the current signal will be removed from the proportional valve 107, closing it and halting the flow of hydraulic fluid from cylinder 14 to reservoir 11 via flow lines 118, 319, with a voltage signal again sent to the directional valve 106, beginning the cycle again (see FIGS. 29 and 31).

It should be understood that the compensating pump 103 is a commercially available known pump such as Parker Model No. PAVC100B 2R422, described in a Parker publication entitled "Series PAVC Variable Displacement Piston Pumps". The control and movement of swash plate 110 between a lower or minimum pressure position of FIG. 32 and a higher pressure position of FIG. 31 is also known. Parker's publication entitled "Series PAVC Variable Displacement Piston Pumps" at page 6 describes a control option "M" that could be used as part of the method of the present invention to control the pump 103 and move swash plate 110 between the positions shown in FIGS. 29-34.

In the FIG. 32 lower or minimum position, servo piston 119 has moved swash plate 110 to an inner position (see arrow 104) wherein the pump pistons 120 move the smallest amount as the cylinder barrel 121 rotates. In FIG. 32, spring 141 only applies minimal pressure against swash plate 110. A wear plate or plates (e.g. brass) 122 form an interface between pump pistons 120 and swash plate 110.

Pump 103 can provide a control spool and sleeve 123 that shifts between different positions (FIGS. 31, 32). In FIG. 32, the minimally pressured pump 103 transmits minimal hydraulic fluid via channels 125, 126, 124, 127, 139 and then to reservoir 11. Flow in channel 129 is throttled using orifice 128.

Swash plate 110 angle controls the output flow of the pump 103. Swash plate 110 angle is controlled by the force generated against the swash plate 110 by the pumping pistons 120 and by the force of the servo piston 119. The force of the servo piston 119 is greater than the force of the pumping pistons 120 when both are at the same pressure.

In FIGS. 29-34, control of pump 103 can employ a proportionally controlled pressure control device installed in the flow line that is in between pump 103 discharge and the reservoir 11. Pump 103 could then maintain pressure approximately equal to the pressure at the pump discharge at location 142 plus the pump differential setting.

By means of internal porting (FIGS. 31, 32), pressure is connected from the output channel 125 to the servo piston 119 via orifice or channel 124 and to the control spool 123 via passage 126. As long as the pressures at both ends of the control spool 123 remain equal, the spool 123 will remain offset upward, due to the added force of the spring 137.

When pressure reaches the setting of the pressure compensator control 138, the spool 123 leaves its seat causing the pressure in the spool chamber to be reduced. The spool 123 now moves downward causing pressure in the servo piston 119 cavity to vent via channel 139. The reduced pressure at the servo piston 119 allows the servo piston 119 to move to the right. This movement reduces the angle of the swash plate 110 and thereby reduces the pumps 103 output flow.

As pump pressure on the control spool 123 drops below pressure and spring force in the spool chamber, the control spool 123 moves upward to maintain an equilibrium on both sides of the spool 123. If pump pressure falls below compensator control setting, the control spool moves up, bringing the pump 103 to maximum displacement.

In FIG. 31, the upstroke position of the apparatus 102 places pump 103 in a high pressure position, swash plate 110 forming a greater angle with the direction 130 of influent flow thus increasing the volume of fluid pumped by each pump piston during pumping. In FIG. 31, valve 106 is open. Flow of fluid in channel 128 is throttled by orifice 128. However, pressure does travel to channel 127 in the direction of arrows 131, 132 to controller 133 and then to piston 119. Piston 119 is operated to increase the angle of swash plate 110 to the FIG. 31 position by pressurized fluid transmitted to piston 119 via channels 125, 126, 124.

A cooling fan or other heat exchanger 134 can be used to cool the hydraulic fluid flowing in flow line 319. Flow line 135 and valve 136 can be used to provide flow to operate cooling fan 134. Flow line 145 supplies oil from line 114 to operate fan 134. Flow line 145 discharge from fan 134 and empties to reservoir 11.

With the oil well pump embodiment of FIGS. 29-34, the swash plate 110 of pump 103 is thus adjusted between high volume pumping (FIGS. 31 and 33) and low or no volume pumping (FIGS. 32 and 34) positions. Control valve 105 is thus operated to control pressure on pump 103 at 142 (FIG. 32) to start the downstroke cycle and to start the apparatus when beginning in an unloaded pump 103 position (FIGS. 32, 34).

In FIGS. 35-42, a manifold 144 is shown that could be used to channel fluids to the various components shown in FIGS. 29-30. The manifold 144 is shown in the downstroke position in FIGS. 35-38. The manifold 145 is shown in the upstroke position in FIGS. 39-42.

The following is a list of parts and materials suitable for use in the present invention.

PARTS LIST

| Part Number | Description |
|---|---|
| 10 | oil well pump |
| 11 | reservoir |

-continued

PARTS LIST

| Part Number | Description |
|---|---|
| 12 | prime mover |
| 13 | compensating pump |
| 14 | hydraulic lift cylinder |
| 15 | cylinder body |
| 16 | hollow interior |
| 17 | cylinder rod |
| 18 | upper end portion |
| 19 | lower end portion |
| 20 | coupling |
| 21 | pumping string/sucker rod |
| 22 | oil well Christmas tree |
| 23 | well pipe |
| 24 | proximity or limit switch |
| 25 | proximity or limit switch |
| 26 | proximity or limit switch |
| 27 | hydraulic flow line |
| 28 | directional valve |
| 29 | hydraulic flow line |
| 30 | drain line |
| 31 | proportioning valve |
| 32 | drain line |
| 33 | flow line |
| 34 | flow line |
| 35 | manifold |
| 36 | cooler |
| 37 | ventable relief valve |
| 38 | frame |
| 39 | programmable logic controller |
| 40 | oil well pump |
| 41 | reservoir |
| 42 | prime mover |
| 43 | compensating pump |
| 44 | manifold |
| 45 | fluid transfer block |
| 46 | directional valve |
| 47 | proportional valve |
| 48 | relief valve |
| 49 | bypass valve |
| 50 | fan flow control |
| 51 | inlet |
| 52 | outlet to cooler and reservoir |
| 53 | outlet to hydraulic lift cylinder |
| 54 | gauge port |
| 55 | cooler |
| 56 | filter |
| 57 | fan motor |
| 58 | manifold |
| 59 | manifold |
| 60 | flow line |
| 61 | valve |
| 62 | flow line |
| 63 | flow line |
| 64 | flow line |
| 65 | flow line |
| 66 | flow line |
| 67 | flow line |
| 68 | flow line |
| 69 | instrumentation line |
| 70 | instrumentation line |
| 71 | instrumentation line |
| 72 | instrumentation line |
| 73 | channel |
| 74 | channel |
| 75 | channel |
| 76 | manifold |
| 77 | fluid transfer block |
| 78 | directional valve block |
| 79 | directional valve block |
| 80 | proportional throttle valve block |
| 81 | proportional throttle valve block |
| 82 | relief valve |
| 83 | bypass valve |
| 84 | fan flow control valve |
| 85 | poppet valve |
| 86 | shuttle valve |
| 87 | flow line |

-continued

PARTS LIST

| Part Number | Description |
|---|---|
| 88 | inlet fitting |
| 89 | flow line |
| 90 | arrow |
| 91 | flow line |
| 92 | arrow |
| 93 | exit fitting |
| 94 | flow line |
| 95 | arrow |
| 96 | arrow |
| 97 | outlet fitting to reservoir |
| 98 | inlet |
| 99 | outlet |
| 100 | conical valving member |
| 101 | conical valving member |
| 102 | oil well pump |
| 103 | compensating pump |
| 104 | arrow |
| 105 | valve |
| 106 | directional valve |
| 107 | proportional control valve |
| 108 | drive |
| 109 | rod end |
| 110 | swash plate |
| 111 | arrow |
| 112 | flow line |
| 113 | suction line |
| 114 | flow line |
| 115 | check valve |
| 116 | flow line |
| 117 | position |
| 118 | flow line |
| 119 | servo piston |
| 120 | pump piston |
| 121 | piston barrel |
| 122 | wear plate |
| 123 | control spool |
| 124 | channel |
| 125 | channel |
| 126 | channel |
| 127 | channel |
| 128 | orifice |
| 129 | channel |
| 130 | direction |
| 131 | arrow |
| 132 | arrow |
| 133 | channel |
| 134 | cooling fan |
| 135 | flow line |
| 136 | valve |
| 137 | spring |
| 138 | compensator control |
| 139 | channel |
| 140 | suction line |
| 141 | spring |
| 142 | location |
| 143 | relief valve |
| 144 | manifold |
| 145 | cooling fan flow line |
| 319 | flow line |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A hydraulic oil well pumping apparatus, comprising:

a) a hydraulic cylinder having a rod that is movable between a upper and lower rod positions;

b) a pumping string that extends downwardly from the rod, the string being configured to extend into an oil well for pumping oil from the well;

c) a prime mover;

d) a hydraulic pump that is powered by the prime mover, said pump having a compensator that regulates pump flow and pump pressure;

e) a directional control valve that moves between open flow and closed flow positions;

f) a flow line connecting the pump and the hydraulic cylinder, the control valve being positioned in the flow line so that it can control flow between the hydraulic pump and hydraulic cylinder;

g) a proportioning valve;

h) a hydraulic fluid reservoir for containing hydraulic fluid to be supplied to the hydraulic pump;

i) a flow line that transmits hydraulic fluid from the hydraulic cylinder to the reservoir via the proportioning valve; and j) an electronic control system that controls movement of the rod as it moves between the upper and lower positions by controlling the control valve and the proportioning valve wherein the control system includes an electrical signal that opens or closes the proportioning valve so that a control of rod movement is enabled when the rod changes direction at the lower position of the rod, and wherein the proportioning valve is choked to lower flow through it as the rod is descending from the upper toward the lower position.

2. The hydraulic oil well pumping apparatus of claim 1 wherein the electronic control system includes a plurality of proximity switches that each send an electronic signal when the rod assumes a selected position relative to the cylinder.

3. The hydraulic oil well pumping apparatus of claim 2 wherein the electronic control system includes a proximity switch that activates the directional control valve to move between open flow and closed flow positions.

4. The hydraulic oil well pumping apparatus of claim 2 wherein the electronic control system includes a proximity switch that activates the directional control valve to move from an open flow position to a closed flow position when the rod reaches the upper rod position relative to the cylinder.

5. The hydraulic oil well pumping apparatus of claim 2 wherein the electronic control system includes a proximity switch that activates the directional control valve to move from a closed flow position to an open flow position when the rod reaches the lower rod position relative to the cylinder.

6. The oil well pumping apparatus of claim 1 wherein the hydraulic pump has a swash plate that is movable between low volume and high volume positions.

7. The oil well pumping apparatus of claim 1 wherein the hydraulic pump has a swash plate that is movable between low pressure and high pressure positions.

8. A hydraulic oil well pumping apparatus, comprising:

a) a hydraulic cylinder having cylinder body and a piston that is movably mounted to the cylinder to travel between a upper and lower piston positions;

b) a pumping string that extends downwardly from the piston, the string being configured to extend into an oil well and including one or more sucker rods for pumping oil from the well;

c) a prime mover;

d) a compensating hydraulic pump that is powered by the prime mover, said pump having a compensator that lessens pump flow as pump pressure increases;

e) a directional control valve that moves between open flow and closed flow positions;

f) a flow line connecting the pump and the hydraulic cylinder, the directional control valve being positioned in the flow line so that it can control flow between the hydraulic pump and hydraulic cylinder;

g) a proportioning valve;

h) a hydraulic fluid reservoir for containing hydraulic fluid to be supplied to the hydraulic pump;

i) a flow line that transmits hydraulic fluid from the hydraulic cylinder to the reservoir via the proportioning valve; and j) an electronic control system that controls movement of the piston as it moves between the upper and lower piston positions by controlling the directional control valve and the proportioning valve wherein the control system includes an electrical signal that opens or closes the proportioning valve so that a control of piston movement is enabled when the rod changes direction at the lower position of the piston, and wherein the proportioning valve is choked to lower flow through it as the piston is descending from the upper toward the lower position.

9. The hydraulic oil well pumping apparatus of claim 8 wherein the electronic control system includes a plurality of proximity switches that each send an electronic signal when the piston assumes a selected position relative to the cylinder.

10. The hydraulic oil well pumping apparatus of claim 9 wherein the electronic control system includes a proximity switch that activates the directional control valve to move between open flow and closed flow positions.

11. The hydraulic oil well pumping apparatus of claim 9 wherein the electronic control system includes a proximity switch that activates the directional control valve to move from an open flow position to a closed flow position when the piston reaches the upper piston position relative to the cylinder.

12. The hydraulic oil well pumping apparatus of claim 9 wherein the electronic control system includes a proximity switch that activates the directional control valve to move from a closed flow position to an open flow position when the piston reaches the lower piston position relative to the cylinder.

13. The oil well pumping apparatus of claim 8 wherein the hydraulic pump has a swash plate that is movable between low pressure and high pressure positions.

14. A hydraulic oil well pumping apparatus, comprising:

a) a hydraulic cylinder having a cylinder rod that is movable between a upper and lower rod positions;

b) a pumping string that extends downwardly from the rod, the string being configured to extend into an oil well for pumping oil from the well;

c) a prime mover;

d) a hydraulic pump that is powered by the prime mover, said pump having a compensator that regulates pump flow and pump pressure;

e) a directional control valve that moves between open flow and closed flow positions;

f) a flow line connecting the pump and the hydraulic cylinder, the control valve being positioned in the flow line so that it can control flow between the hydraulic pump and hydraulic cylinder;

g) a proportioning valve;

h) a hydraulic fluid reservoir for containing hydraulic fluid to be supplied to the hydraulic pump;

i) a flow line that transmits hydraulic fluid from the hydraulic cylinder to the reservoir via the proportioning valve; and j) an electronic control system that controls movement of the cylinder rod as it moves between the upper and lower positions by controlling the control valve and the proportioning valve wherein the control system includes an electrical signal that opens or closes the proportioning valve so that the rod slows down its travel speed as it approaches the lower rod position.

15. The hydraulic oil well pumping apparatus of claim 14 wherein the electronic control system includes a plurality of proximity switches that each send an electronic signal when the rod assumes a selected position relative to the cylinder.

16. The hydraulic oil well pumping apparatus of claim 15 wherein the electronic control system includes a proximity switch that activates the directional control valve to move between open flow and closed flow positions.

17. The hydraulic oil well pumping apparatus of claim 15 wherein the electronic control system includes a proximity switch that activates the directional control valve to move from an open flow position to a closed flow position when the rod reaches the upper rod position relative to the cylinder.

18. The hydraulic oil well pumping apparatus of claim 15 wherein the electronic control system includes a proximity switch that activates the directional control valve to move from a closed flow position to an open flow position when the rod reaches the lower rod position relative to the cylinder.

19. The oil well pumping apparatus of claim 14 wherein the hydraulic pump has a swash plate that is movable between low volume and high volume positions.

20. The oil well pumping apparatus of claim 14 wherein the hydraulic pump has a swash plate that is movable between low pressure and high pressure positions.

* * * * *